US011135607B2

(12) United States Patent
Ballot et al.

(10) Patent No.: US 11,135,607 B2
(45) **Date of Patent: *Oct. 5, 2021**

(54) TRIGGER PUMP DISPENSER

(71) Applicant: FLOCON, Inc., Woodstock, IL (US)

(72) Inventors: Stephan M. Ballot, Barrington Hills, IL (US); David A. Snyder, Sharon, WI (US); Fred M. Ekstrom, Algonquin, IL (US); Robert D. Forschler, Lakewood, IL (US); Thomas A. Nelsen, Wauconda, IL (US)

(73) Assignee: FLOCON, INC., Woodstock, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/780,185

(22) Filed: Feb. 3, 2020

(65) Prior Publication Data

US 2020/0261937 A1 Aug. 20, 2020

Related U.S. Application Data

(63) Continuation of application No. 15/786,173, filed on Oct. 17, 2017, now Pat. No. 10,549,297.

(60) Provisional application No. 62/409,698, filed on Oct. 18, 2016.

(51) Int. Cl.
*B05B 11/00* (2006.01)

(52) U.S. Cl.
CPC ..... *B05B 11/3011* (2013.01); *B05B 11/3002* (2013.01); *B05B 11/3057* (2013.01)

(58) Field of Classification Search
CPC ..... B05B 11/3011; B05B 11/3002; B05B 11/3057
See application file for complete search history.

(56) References Cited

U.S. PATENT DOCUMENTS

| | | | | |
|---|---|---|---|---|
| 3,897,006 | A | 7/1975 | Tada | |
| 3,913,841 | A | 10/1975 | Tada | |
| 4,082,223 | A * | 4/1978 | Nozawa | B05B 11/3009 222/321.8 |
| 4,199,083 | A | 4/1980 | LoMaglio | |
| 4,273,268 | A | 6/1981 | Wickenberg | |
| 4,278,187 | A * | 7/1981 | Luedtke | B05B 11/306 222/153.13 |
| 4,527,741 | A | 7/1985 | Garnbeau | |
| 4,558,821 | A | 12/1985 | Tada et al. | |
| 4,646,969 | A | 3/1987 | Sorm et al. | |
| 4,826,052 | A | 5/1989 | Micallef | |
| 4,955,511 | A | 9/1990 | Blake | |
| 5,054,659 | A | 10/1991 | Micallef | |
| 5,156,304 | A * | 10/1992 | Battegazzore | B05B 11/3014 222/341 |

(Continued)

FOREIGN PATENT DOCUMENTS

JP 2006 326450 A 12/2006

*Primary Examiner* — Jeremy Carroll
(74) *Attorney, Agent, or Firm* — Frijouf, Rust & Pyle, P.A.

(57) ABSTRACT

An improved pump is disclosed comprising a pump body having a piston supported by a base from a fluid reservoir. A trigger extends a between a first portion and a second portion with an intermediate trigger pivot mounted relative to the base. A cam and a cam follower couples the first portion of the trigger with the piston for enabling a depression of the second portion trigger to move the piston to spray fluid from the pump body orifice.

18 Claims, 27 Drawing Sheets

(56) References Cited

U.S. PATENT DOCUMENTS

| | | | | | |
|---|---|---|---|---|---|
| 5,257,724 | A * | 11/1993 | Steijns | B05B 11/3045 | 222/153.06 |
| 5,318,206 | A | 6/1994 | Maas et al. | | |
| 5,341,967 | A | 8/1994 | Silvenis | | |
| 5,344,053 | A | 9/1994 | Foster et al. | | |
| 5,402,916 | A | 4/1995 | Nottingham et al. | | |
| 5,492,275 | A | 2/1996 | Crampton | | |
| 5,711,459 | A | 1/1998 | Glynn | | |
| 5,810,209 | A | 9/1998 | Foster | | |
| 5,996,847 | A | 12/1999 | Smolen, Jr. et al. | | |
| 6,126,090 | A * | 10/2000 | Wadsworth | B05B 1/12 | 222/380 |
| 6,234,412 | B1 | 5/2001 | von Schuckmann | | |
| 6,364,174 | B1 | 4/2002 | Lohrman et al. | | |
| 6,439,481 | B2 | 8/2002 | von Schuckmann | | |
| 6,578,742 | B1 * | 6/2003 | Schuckmann | B05B 11/3011 | 222/383.1 |
| 6,595,246 | B2 | 7/2003 | Brozell et al. | | |
| 6,910,605 | B2 * | 6/2005 | Schuckmann | B05B 11/3011 | 222/321.8 |
| 9,004,322 | B2 | 4/2015 | Graham | | |
| 2001/0030246 | A1 * | 10/2001 | Schuckmann | B05B 1/3436 | 239/333 |
| 2004/0222243 | A1 * | 11/2004 | Sweeton | B05B 11/3009 | 222/383.1 |
| 2007/0210106 | A1 * | 9/2007 | Foster | B05B 11/3011 | 222/153.06 |
| 2012/0227763 | A1 * | 9/2012 | Hayes | A47L 13/22 | 134/6 |

* cited by examiner

COMP1 TESTING 4.04

COMP2 TESTING 5.26

FLOCON BLACK TESTING 2.36

TRIGGER PUMP DISPENSER

FIELD OF THE INVENTION

This invention relates to the dispensing of fluids and liquids and more particularly, this invention relates to an improved trigger pump dispenser and an improved trigger actuator for a pump.

BACKGROUND OF THE INVENTION

Various types of trigger pump dispensers have been devised for dispensing a wide range of liquids and fluids. These trigger pump dispensers of the prior art have received wide acceptance due in great measure to the convenience of the devices. It is most desirable for a trigger pump to provide an efficient spray with minimum trigger finger pressure. In order to provide an efficient spray with minimum trigger finger pressure, continuing efforts have been made in the past to improve the design of the trigger pump dispensers. The improved design of the trigger pump dispensers have concentrated on the pumping dispensing mechanism and for improving the communication of the fluid from the fluid reservoir to a terminal orifice. The following patents and publications are representative of attempts of the prior art to advance the trigger pump art.

U.S. Pat. No. 3,897,006 to Tada discloses a sprayer including a container for receiving a liquid therein, a sprayer head having a piston for sucking and ejecting the liquid from a nozzle, and a neck portion coupling the head to the container, the neck portion having a vent for permitting the interior of the container to communicate with the open air. The vent is normally closed by a flexible closing member and, when the piston is operated, is opened by an operating rod to release a negative pressure within the container.

U.S. Pat. No. 3,913,841 to Tada discloses a sprayer adapted to suction a liquid under back pressure and squirt the liquid in the atomized form from the nozzle by applying a pressure to the liquid. The sprayer comprises a sprayer body having a suction pipe and a cylinder communicating with the suction pipe, and a cylindrical projection extending from the closed end toward the open end of the cylinder and communicating with the suction pipe. A piston is slidably mounted to the sprayer body in a manner to surround the cylindrical projection. The piston defines such a liquid chamber that when the piston is moved into closest proximity to the closed end of the cylinder the volume of the liquid chamber is made minimal. As a result, when the piston is so moved, a liquid within the chamber is squirted efficiently at high pressure.

U.S. Pat. No. 4,199,083 to LoMaglio discloses a manually actuated trigger pump adapted to be fitted on the neck of a container for dispensing a liquid therefrom. The pump includes a main housing with a trigger connected thereto, a flexible bladder which fits in the housing and is engagable by the trigger, and a nozzle which is attached to the housing. The trigger engages the bladder to pump fluid from the bladder outwardly through the nozzle.

U.S. Pat. No. 4,273,268 to Wickenberg discloses a fluid spray pump for spraying a fluid from a fluid container through a terminal orifice comprising a housing having an internal cylinder with a first and a second end. A collar with an internal collar aperture is mounted adjacent the first end of the housing internal cylinder. A pump barrel is slidably received in the internal collar aperture and includes a barrel internal bore communicating with a terminal orifice in the pump barrel. A piston comprising a piston stem is received in the barrel internal bore of the piston barrel and with a piston head received within the housing internal cylinder. Channels are provided along the piston stem for communicating the housing internal cylinder with the terminal orifice. An annular seal is slidably mounted relative to the piston and the pump barrel for sealing the channel means when the annular seal abuts a shoulder formed between the piston head and the piston stem. The annular seal enables fluid flow through the channel means to the terminal orifice when the annular seal is displaced from the piston shoulder by movement of the pump barrel toward the second end of the housing internal cylinder U.S. Pat. No. 4,527,741 to Garneau discloses a trigger sprayer comprising a body having an upper horizontally extending portion and a lower generally vertically extending portion. The body has a passageway therein extending from one end of the upper portion to the bottom of the lower portion. A cylindrical hollow and a cylindrical cavity extend into the lower body portion from the bottom thereof. An insert member is adapted to be received in the hollow and cavity, and has a passageway therethrough communicating with the body passageway, a cap coupled to the lower end of the insert member to a container of fluid. A check valve assembly is associated with the insert member to a container of fluid. A check valve assembly is associated with the insert member passageway and includes a lower check valve. At least one of the valves includes an elongate valve member and a frusto-conical shaped skirt extending forwardly from the valve member. A pumping assembly is mounted to the body and communicates with the insert member passageway between the upper and lower check valves.

U.S. Pat. No. 4,558,821 to Tada discloses a trigger-type sprayer according to the present invention sucks up, pressurizes and sprays a liquid contained in a container having a mouth portion. The sprayer is provided with a housing attached to the mouth portion of the container, a trigger rockably attached to one end portion of the housing, a nozzle formed on the trigger and having an orifice, a cylinder supported at the middle portion on the housing and capable of facing the orifice, a suction tube attached to the other end portion of the cylinder and connecting the interior of the cylinder and that of the container, a piston one end of which is connected to the nozzle and the other end of which is located in the cylinder, the piston slidably touching the inner surface of the cylinder, a primary valve for selectively connecting the suction tube and the cylinder, and a secondary valve for selectively connecting the cylinder and the piston. The housing, trigger, nozzle, cylinder and suction tube are integrally formed.

U.S. Pat. No. 4,646,969 to Sorm, et al. discloses a double-acting mechanical liquid spraying device having a housing which is adapted to be mounted upon and sealed to the neck of a liquid container, and which has a liquid-containing compartment therein. In the housing, aligned with the liquid-containing compartment, there is an operation cylinder which has an annular valve seat disposed transversely to and intermediate the length of such cylinder. Disposed within the liquid-containing compartment is a liquid pumping plunger of the cuff type which cooperates with the valve seat to close the opening through such seat when the plunger is in its forward terminal position, and which is driven to reciprocate within the liquid-containing compartment in forward and reverse liquid dispensing strokes. In each of such strokes the plunger forwards liquid from the liquid-containing compartment to a spray nozzle through a liquid-conducting passage. Interposed in the liquid-conducting passage between the plunger and the spray nozzle are a relief valve and a relief passage which bleed liquid back to the liquid container and allow atmospheric air to be drawn in through the spray nozzle at the end of the reverse stroke of the plunger, thereby to clear the spray nozzle of liquid at the end of each pumping cycle consisting of a forward and a reverse stroke. As a consequence, fast-drying liquids can be sprayed with the device of the invention.

U.S. Pat. No. 4,826,052 to Micallef discloses a dispensing pump for dispensing product from a container and serves as a container closure. The pump has a cylinder having an inner shell open at its rear end and closed at a forward end and an outer shell surrounding the inner shell and defining a cavity therebetween. A reciprocally mounted piston is in the inner shell and defines a pump chamber therewith. Inlet port means includes a passage in the outer shell for communication the container interior with the pump chamber during the suction stroke to permit product to pass through the inlet port into the cavity and then into the pump chamber. A vent replaces product removed from the container interior into the pump chamber with air. An outlet valve is provided for opening the outlet port during the compression stroke and for closing the outlet port during the suction stroke; and an inlet valve is provided for opening the inlet port during the suction stroke and for closing the inlet port during the compression stroke.

U.S. Pat. No. 4,955,511 to Blake discloses an inexpensive, disposable trigger actuated pump in which the shroud and nose piece are molded as a single unit. In one form of the invention, the pump housing is molded as a single unit with the shroud and nose piece, and a trigger actuator and piston pump are also molded as a single unit for subsequent assembly with the shroud, housing and nose piece unit, return spring, nose valve, dip tube and container to form a completed pump. The trigger actuated pump of the invention thus comprises fewer parts than conventionally manufactured pumps, thereby reducing inventory requirements and assembly steps and consequently reducing the manufacturing costs, enabling the pump to be disposed of after the contents of the container are emptied.

U.S. Pat. No. 5,054,659 to Micallef discloses a double acting trigger pump on a container includes a cylinder and a piston reciprocal therein that cooperate in providing a primary pump chamber. An inlet valve regulates product being drawn into the primary pump chamber. A double piston seal is at the inner end of the piston and includes an outlet valve coaxial with a longitudinal bore in the piston. A supplemental pump chamber that also communicates with the bore is defined between outer surfaces of the piston and inner surfaces of the cylinder as well as the double piston seal and a rearward retaining ring. During the pressure stroke of the piston, product is dispensed from the primary pump chamber out from the pump and fills the supplemental pump chamber. During the suction stroke of the piston, product is drawn into the primary pump chamber from the container and product is discharged from the supplemental pump chamber out from the pump.

U.S. Pat. No. 5,318,206 to Maas, et al. discloses a trigger operated pumping mechanism for a fluid dispensing device having a body and the pumping mechanism comprises a cylinder in the body of the dispensing device, a piston received in the cylinder and having a piston rod extending outwardly therefrom to an outer end and a trigger movably mounted to the body and having a front side and a back side. A first coupling structure is provided on the outer end of the piston rod for coupling to the trigger. A second coupling structure is provided on the back side of the trigger for releasably coupling to the first coupling structure on the piston rod in a snap-fitting manner and a spring is provided outside of the cylinder for biasing the trigger away from the body.

U.S. Pat. No. 5,341,967 to Silvenis discloses a trigger sprayer dispenser which can be used to dispense liquids in multidirections. The present invention incorporates a mechanism in a conventional trigger sprayer to allow the sprayer to be used in an inverted position without the dispenser contents leaking through a sprayer vent orifice. The mechanism comprises a by pass chamber in communication with the chamber of the dip tube. The by pass chamber then creates an auxiliary fluid path to the dip tube fluid path when the dispenser is inverted. When the dispenser is inverted, the fluid remaining in the dip tube acts as a fluid lock thereby preventing internal dispenser air from escaping out from the dip tube into the trigger sprayer. The by pass mechanism therefore, also allows for more efficient evacuation of the dispenser contents.

U.S. Pat. No. 5,344,053 to Foster, et al. discloses a trigger sprayer apparatus is including a sprayer housing and a vent housing that are formed independently of each other and are then assembled together. By providing a separate sprayer housing and vent housing, the sprayer apparatus may be produced in a manner that significantly reduces the occurrence of deformations or imperfections in the component parts of the apparatus. Molding the sprayer housing and vent housing separately enables the cylindrical interior surface of the pump chamber and the cylindrical interior surface of the vent chamber to be molded more accurately. Because the sprayer and vent housings are molded separately, a lesser amount of material is needed to mold each of these components and therefore shrinkage of the material as the components cool is significantly reduces. This eliminates the occurrence of deformations or sinks in critical areas of these component parts.

U.S. Pat. No. 5,402,916 to Nottingham, et al. discloses a hand-actuated multiple-container trigger sprayer including a sprayer head assembly removably connected to a plurality of fluid containers. The sprayer head assembly has an outer housing, a nozzle attached to the housing, pump mechanism enclosed within the housing, and tubing fluidly connecting each of the plurality of fluid containers with the pump mechanism in the housing. A trigger or lever actuates the pump mechanism to draw fluid through the tubing from each of the plurality of fluid containers and to discharge the fluid through the nozzle. A metering device is located between the fluid containers and the pump mechanism and is accessible externally from the housing to selectively control the amount of fluid drawn from the containers. The metering device includes flow paths to the pump mechanism for each of the fluid containers. The diameter and length of at least one of the flow paths can be controlled to selectively control the amount of fluid drawn from the fluid containers.

U.S. Pat. No. 5,492,275 to Crampton discloses a hand pump sprayer and system for dispensing viscous liquids. A nozzle is rotatably mounted around the delivery passageway of a hand pump sprayer. The nozzle is interconnected to the trigger of the hand pump sprayer so that the nozzle rotates, upon pulling of the trigger, simultaneously with the discharge of the liquid to the atmosphere. The nozzle rotates about an axis of rotation through the center of the discharge end of the nozzle through an angle of rotation from about 90 degrees to about 360 degrees, desirably from 180 degrees to 360 degrees and preferably 270 degrees or more. Desirably the nozzle has two discharge outlets which direct fluid expelled from the hand pump sprayer along intersecting discharge axes. Simultaneously as the fluid is discharged along the intersecting axes, the nozzle is rotated about the axis of rotation. The resulting dispensed liquid has a high degree of atomization and a desirable round spray pattern.

U.S. Pat. No. 5,711,459 to Glynn discloses a continuous action trigger sprayer for spraying liquid material. It includes a main housing having connectors to a container and having an operation cylinder and a liquid chamber. It also includes a pumping element which is within the operation cylinder and has a valve seat, a one-way valve and a pumping rod, which permits liquid material to pass therethrough in a relative direction toward a spray nozzle, but not toward the liquid chamber. There is a relief valve having a seat with an opening therethrough and a relief passage to bleed liquid back to the container and which cooperates with the pumping element. There is also a trigger which moves the pumping element.

U.S. Pat. No. 5,810,209 to Foster discloses a dispenser comprising a container for containing fluid to be dispensed and a manually operated reciprocating fluid pump adapted to be secured to the container. The fluid pump includes a pump mechanism, an intake port adapted for fluid communication with liquid contained in the container, an intake liquid flow path providing fluid communication between the intake port and the pump mechanism, a discharge port, a discharge liquid flow path providing fluid communication between the pump mechanism and discharge port, and a closure cap portion configured for connection to the container. The closure cap portion comprises a generally annular-shaped skirt, a lug extending generally radially inwardly from an inside surface of the skirt, and an aperture in the skirt and circumferentially spaced from the lug. The container includes a neck having a mouth therein for passage therethrough of liquid in the container. The container further includes a bayonet provision on an outer surface of the neck for matably receiving the lug of the closure cap portion, and a radially extending tab configured for extending into the aperture of the skirt. The lug is shaped and configured to mate with the bayonet provision and the tab is shaped and configured to mate with the aperture when the skirt of the closure cap portion is positioned on the neck of the container to releasably lock the closure cap portion to the neck of the contain U.S. Pat. No. 5,996,847 to Smolen, Jr., et al. discloses a pair of substantially identical unitary plastic molded units, each unit having a tubular stem formed with a piston at one end and a nozzle head at the other. Each unit has a female snap-type connector facing to one side and spaced therefrom a male snap-type connector facing to the same side, the molded units being disposed side-by-side with the male snap-type connectors snappingly received into the female snap-type connectors of the respective stems.

U.S. Pat. No. 6,234,412 to von Schuckmann discloses a spray pump capable of being actuated by a hand lever, to be mounted on dispensers or the like. The pump comprises a piston pump capable of sliding linearly in a pump chamber on the housing side. The piston is connected, on the rear side of an outlet, to the hand lever and returns to its base position urged by a spring. The invention aims at producing a pump which is both simple and reliable by associating two articulating parts with the lever. One of the parts is located so as to slide in a linear slider on the housing side, and the other is fixed to the housing, on the side opposite the outlet, such that the two articulating parts are connected by mutually collapsible contiguous parts.

U.S. Pat. No. 6,364,174 to Lohrman, et al. discloses a piston/nozzle unit retainer and stop comprises inward fingers in the cylinder slots receiving the trigger trunions which drive the unit.

U.S. Pat. No. 6,439,481 to von Schuckman discloses a hand lever-operated spray pump, particularly for attaching to bottles or similar, having a pump plunger which moves linear in a pump chamber on the housing side and which is connected with the hand lever at the rear of a mouth piece opening and which returns to its starting position as a result of a spring loading, and proposes, for the purpose of achieving a structurally simple, functionally reliable solution, to allocate two hinge points to the hand lever one of which is movable in a linear guide on the housing side and the other is arranged on the housing on the side opposite to the mouthpiece. In such a way that both hinge points are connected by means of two buckling bridge sections.

U.S. Pat. No. 6,595,246 to Brozell, et al. discloses a pump body mounted on a container and has a forward manually operated pump and a rearward vertical container fill conduit. In the filling process, the container is filled through the conduit, and a closure is then applied to the top of the conduit. The closure may be part of the pump body housing. Multiple containers with their pump bodies may be filled simultaneously.

U.S. Pat. No. 6,910,605 to Schuckmann, et al. discloses a pump which is actuable by a hand lever for spraying liquid, especially for placing on bottles with a pump piston which is linearly displacable in a pump chamber on a housing side, against force of a compression spring, for spraying the liquid out of a mouthpiece nozzle. The pump piston being coupled to the pin-mounted hand lever by a connecting pull member, the connecting pull member, extending from a rear side of the pump piston, parallel to the displacement path of the pump piston in the direction of the mouthpiece nozzle, and a cross-piece on the rear side of the pump piston as a carrier of the pump piston, forming a single element therewith, wherein bearing pin portions of the hand lever are hooked into open slits, loaded by compressive force of the compression spring toward a slit end, and wherein an opening, which is partially surrounded by a frame-shaped the connecting pull member in longitudinal direction of the pump, is pivotable on a hand lever side of a compressed the compression spring over end of a carrying tube to be fitted with mouthpiece.

U.S. Pat. No. 9,004,322 to Graham discloses a hand held spray bottle for use in the downward application of a liquid onto a horizontal surface. The spray bottle generally comprises a liquid spray device and a liquid storage bottle with an open threaded top to which the spray device is attached. The liquid spray device contains an internal pump assembly, trigger, and nozzle.

United States Patent Application 2004/0222243 discloses a low-cost, in-line trigger actuated pump sprayer having a pump body which may have an integral container closure and/or integral shroud cover with a trigger lever trunnion mounted to the pump body or with a trigger lever assembly mounted to the pump body as including a living hinge. A hollow pump piston defines a discharge passage lying perpendicular to the central axis of the closure, and an elastomeric element may be provided with functions as a piston return spring, inlet check valve and discharge check valve.

Although the forgoing patents have contributed to the advancement of the prior art, there is still a need for a simple, trigger pump dispenser incorporating an efficient trigger actuator for the pump.

Therefore, it is an object of the present invention to provide an improved trigger pump dispenser that provides a substantial advancement to the trigger pump art.

Another object of the present invention is to provide an improved trigger pump dispenser having superior spray characteristics over the prior art.

Another object of the present invention is to provide an improved trigger pump dispenser having a linear flow path from a pump piston to a terminal orifice.

Another object of the present invention is to provide an improved trigger pump dispenser providing a reduced trigger actuation force.

Another object of the present invention is to provide an improved trigger pump dispenser having novel linkage interconnecting the trigger and the pump piston.

Another object of the present invention is to provide an improved trigger actuator for a pump having interchangeable covering hood for changing the appearance of the pump dispenser.

Another object of the present invention is to provide an improved trigger actuator for a pump that is simpler in design and more economical to manufacture.

Another object of the present invention is to provide an improved trigger actuator for a pump that has a reduced number of parts.

Another object of the present invention is to provide an improved trigger actuator configuration for a pump dispenser capable of accommodating different and interchangeable pump types.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention and the detailed description describing the preferred embodiment of the invention.

SUMMARY OF THE INVENTION

The present invention is defined by the appended claims with the specific embodiments shown in the attached drawings. For the purpose of summarizing the invention, the invention comprises an improved pump dispenser for discharging a fluid from a fluid reservoir comprising a pump body having a piston. A base supports the pump body relative to the fluid reservoir. A trigger extends a between a first portion and a second portion. A base pivot pivotably mounts the trigger relative to the base. A cam and a cam follower couples the first portion of the trigger with the piston for enabling a depression of the second portion trigger to move the piston to spray fluid from the pump body orifice.

In one embodiment of the invention, the base attachment of the pump body to the base in a deformable engagement enabling the interchange of different pump bodies. An optional hood covers the pump body for changing the appearance of the pump dispenser.

In a more specific example, an arm extends from the base with the base pivot mounted on the arm for pivoting the trigger. The cam is located on the first portion of the trigger and the cam follower is connected to the piston. The cam follower is disposed on a linkage interconnected to the piston. The cam follower disposed on the linkage transforms a pivoting movement of the cam into a linear movement of the cam follower. Preferably, the linkage is slidably mounted to the pump body.

In still another specific example, the pump body extends between a first and a second cylindrical end. A linear slot is defined in the pump body. The linkage is slidably mounted in the linear slot.

The pump body extends between a first and a second cylindrical end with a pump body orifice defined in the first end of the pump body for providing a linear fluid path from the piston to the pump body orifice. A return spring biases the piston in an unattended position. A pivot of the trigger moves the piston against the bias of the spring for spraying a fluid from the pump body orifice.

In another example, the cam comprises a first and a second cam defined in the first portion of the trigger. The linkage comprises a generally U-shape linkage straddling opposed sides of the pump body for engaging with the piston. The cam follower comprises a first and a second cam follower located on a first and a second distal end of the generally U-shape linkage for coupling with the first and second cams defined in the first portion of the trigger enabling a pivoting movement of the second portion trigger to move linearly the piston to spray fluid from the pump body orifice. In one example, each of the first and second cam followers includes plural cam follower projections.

In this example, a first and a second linear slot is defined in opposed sides of the pump body with the generally U-shape linkage slidably mounted in the first and second linear slots. The first and second cams are defined in the first portion of the trigger on opposed adjacent sides of the pump body orifice.

The invention is also incorporated into an improved actuator for a pump, the pump having a pump body with a piston slidably mounted therein for discharging a fluid through a pump body orifice from a fluid reservoir. The improved actuator comprises a base having a fluid reservoir attachment for connecting to the fluid reservoir. A base connector secures the pump body to the base enabling the interchange of different pump bodies.

The foregoing has outlined rather broadly the more pertinent and important features of the present invention in order that the detailed description that follows may be better understood so that the present contribution to the art can be more fully appreciated. Additional features of the invention will be described hereinafter which form the subject matter of the invention. It should be appreciated by those skilled in the art that the conception and the specific embodiments may be modified for carrying out the same purposes of the present invention. It should also be realized by those skilled in the art that such equivalent constructions do not depart from the spirit and scope of the invention.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
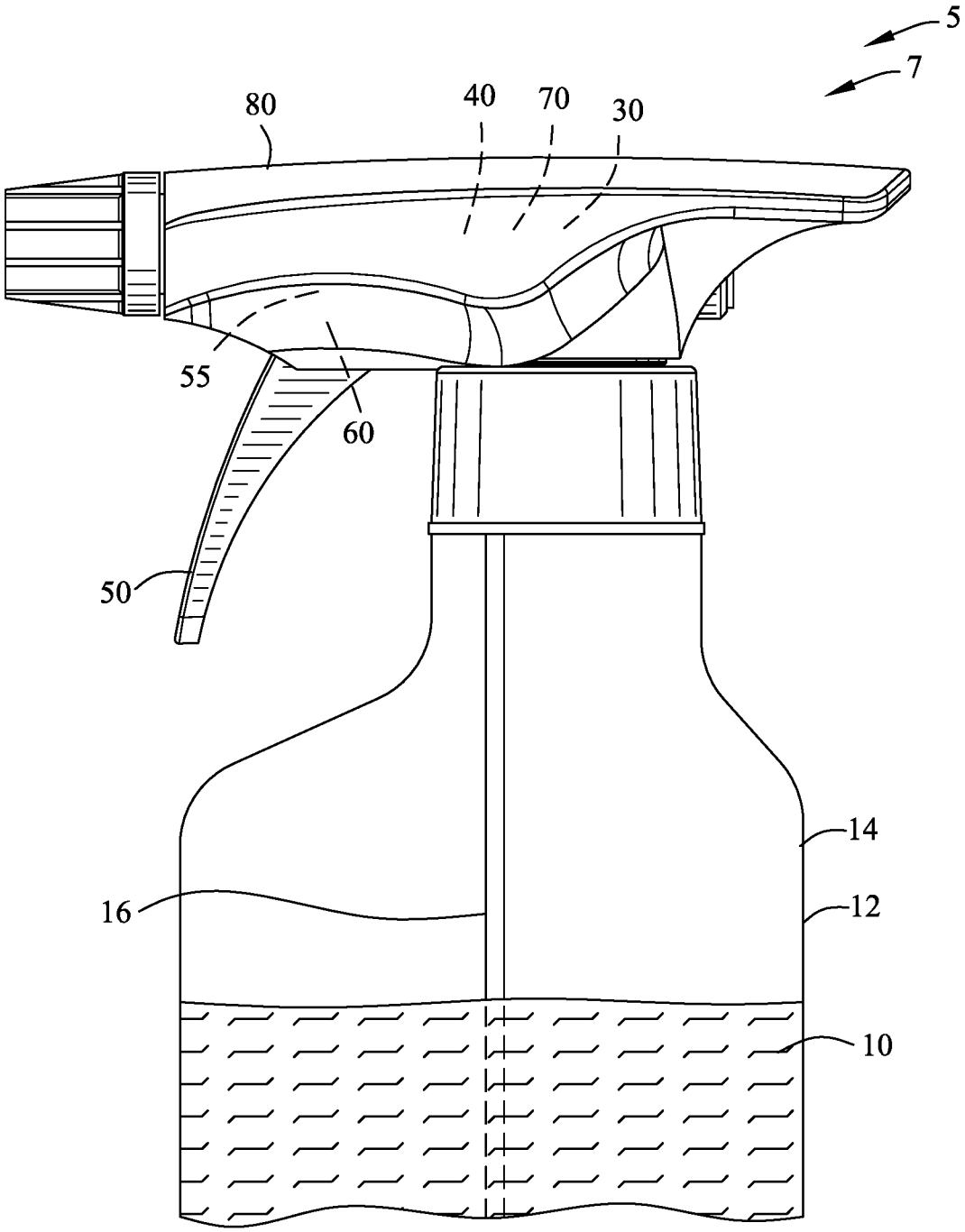
FIG. 1 is side view of a first embodiment of an improved pump dispenser of the present invention.
Figure 2:
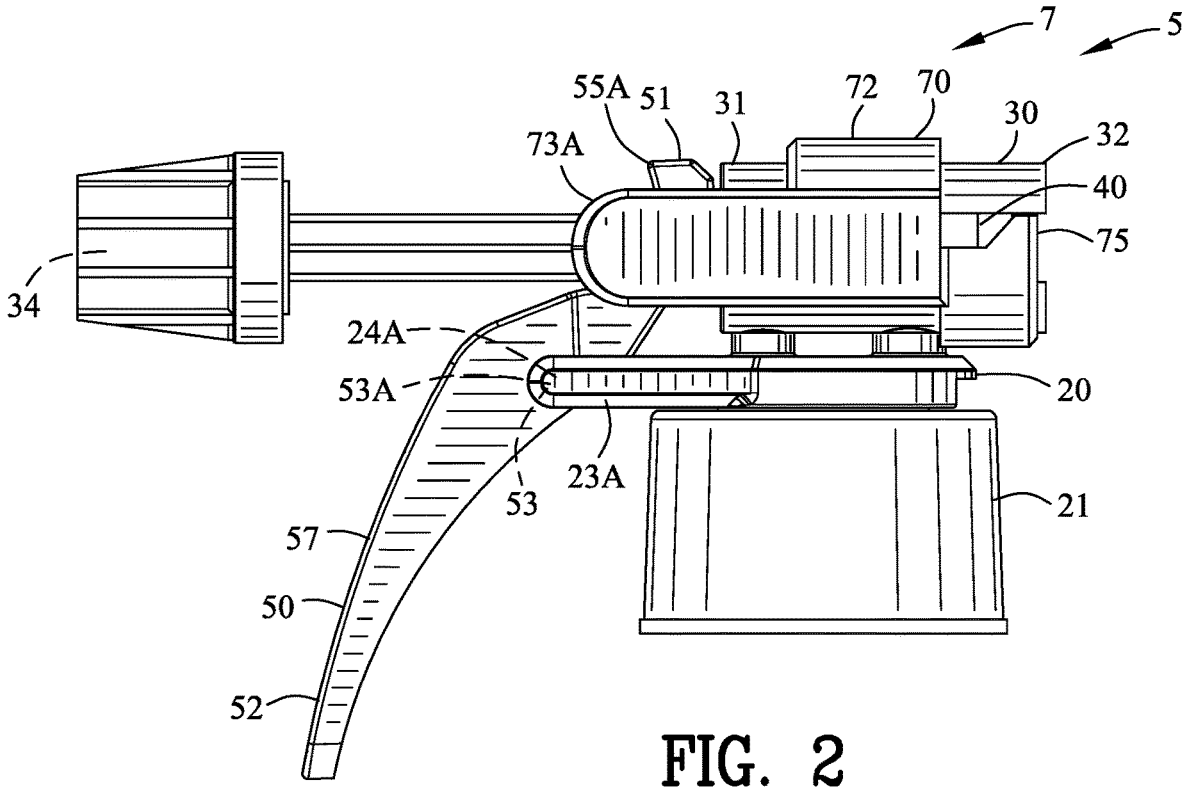
FIG. 2 is side view of the improved pump dispenser of FIG. 1 with a decorative cover removed.
Figure 60:
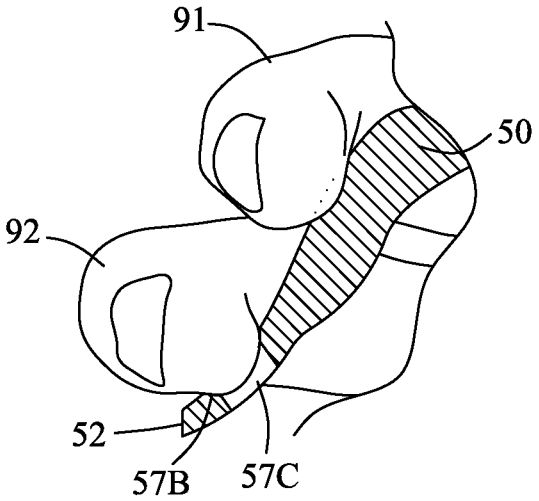
FIG. 60 is an enlarged sectional view of the trigger of FIG. 59 illustrating the hand engaging the trigger.

FIGS. 1-60 illustrate an improved pump dispenser 5 and an improved actuator for a pump 7. The improved pump dispenser 5 and improved actuator for a pump 7 of the present invention discharges a fluid 10 from a fluid reservoir 12 shown as a container 14. The improved pump dispenser 5 or an actuator 7 comprises a base 20 supporting a pump body 30 relative to the fluid reservoir 12. The pump body 30 has a piston 40 operated by a trigger 50 through a cam 55 and a cam follower 60 and a linkage 70 for enabling a depression of the trigger 50 to spray fluid 10 from the pump body 30.

The improved pump dispenser 5 includes decorative hood 80 for covering the pump body 30, the cam 55, the cam follower 60 and the linkage 70. Preferably, the decorative hood 80 is interchangeable during the assembly process for changing the appearance of the pump dispenser for various different application, different users, different customers and the like.

FIGS. 2-5 and 32-35 are various views of the improved pump dispenser 5 of the present invention with the decorative hood 80 removed. The base 20 includes a fluid reservoir attachment 21 for attaching the base 20 to the fluid reservoir 12. A base sleeve lock 27 may engage the base 20 for positioning the fluid reservoir attachment 21 there between and attaching the base 20 to the fluid reservoir attachment 21. The fluid reservoir attachment 21 may comprise various attachment devices that are well known to those skilled in the art.

In this example, the base 20 is separate from the pump body 30. As will be described in greater detail with reference to FIGS. 6-7 and 36-37, a base connector 22 connects the pump body 30 to the base 20 in a deformable engagement. The separation of the base 20 from the pump body 30 enables the interchange of different pump bodies. The interchange of different pump bodies permit the actuator of the present invention comprising the cam 55 and the cam follower 60 to be used with different pump designs, different pump characteristic and different pump fluids. In the alternative, the base 20 and the pump body may be formed from a single unitary polymeric material.

The base 20 includes a base arm 23 extending from the base 20. A base pivot 24 is located on the base arm 23 for pivoting the trigger 50. In this example, the base 20 includes a first and a second base arm 23A and 23B extending from the base 20 with first and second base pivots 24A and 24B mounted on the first and second base arms arm 23A and 23B. The first and second base pivots 24A and 24B are shown as integral pins extending toward one another between the first and second base arms arm 23A and 23B.

Figure 5:
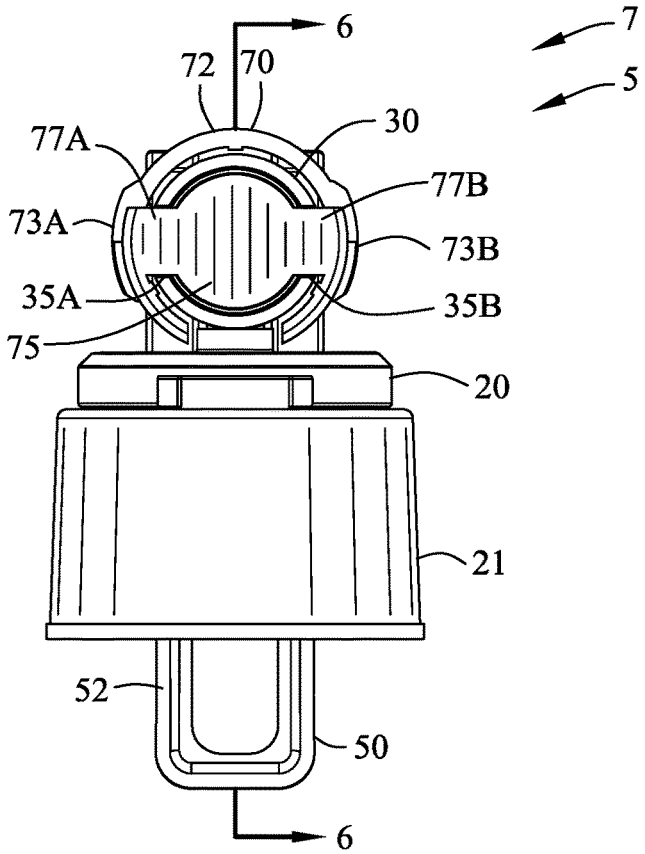
FIG. 5 is a rear view of FIG. 2.
Figure 6:
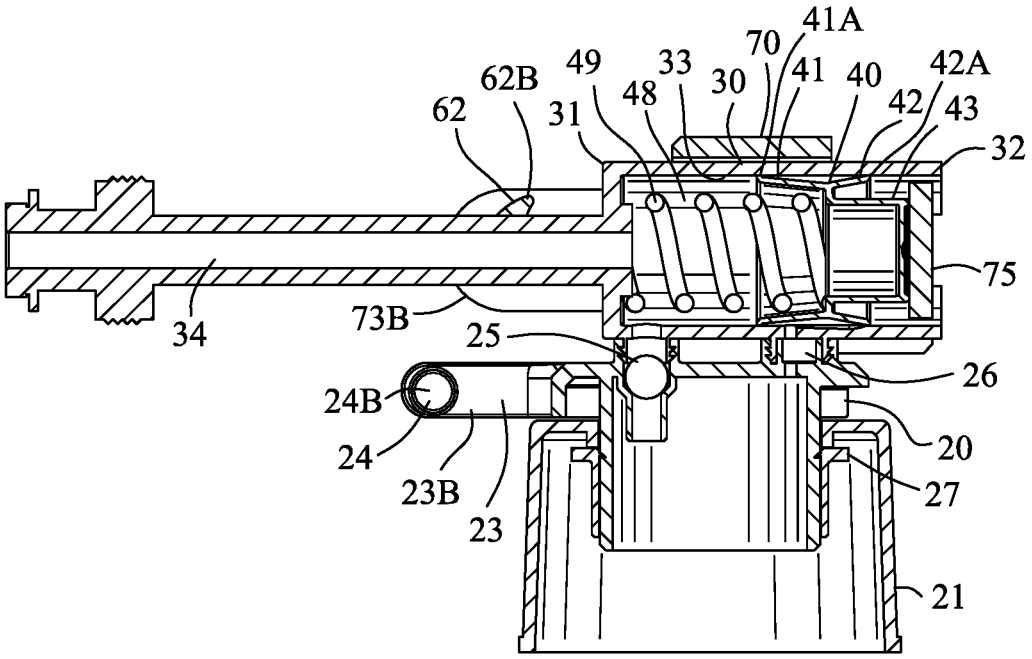
FIG. 6 is a sectional view along line 6-6 in FIG. 5 with the trigger removed.
Figure 36:
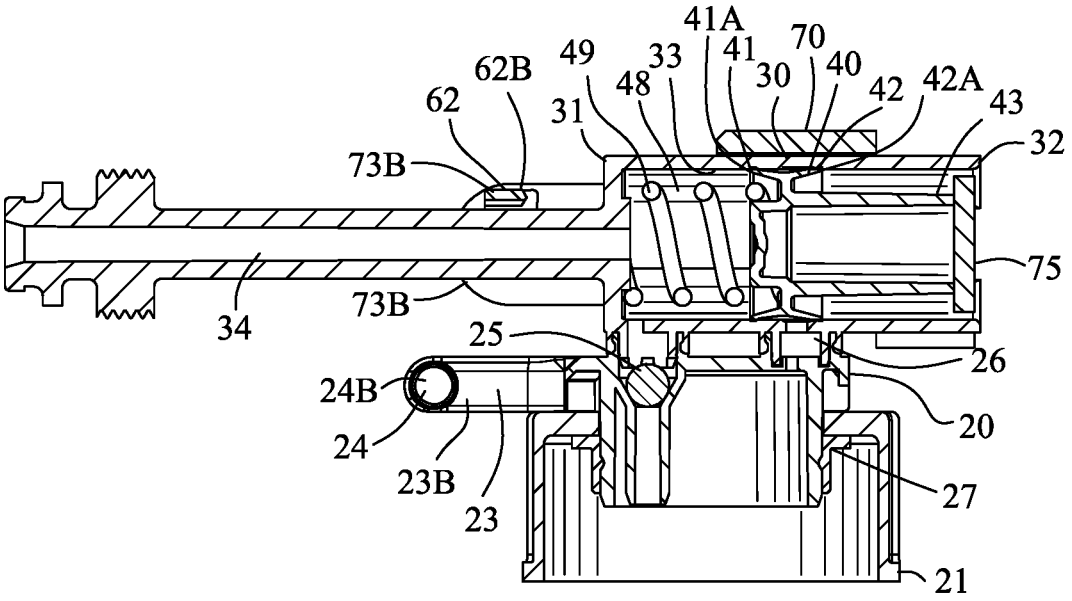
FIG. 36 is a sectional view along line 36-36 in FIG. 35 with the trigger removed.

FIG. 6 is a sectional view along line 6-6 in FIG. 5 with the trigger 50 removed. FIG. 36 is a sectional view along line 36-36 in FIG. 35 with the trigger 50 removed. The base 20 includes a one-way valve 25 communicating the pump body 30 with the fluid reservoir 12 for enabling fluid to flow from the fluid reservoir into the pump body 30. A dip tube 16 may be coupled adjacent to the one-way valve 25 for withdrawing the fluid 10 from the bottom of the fluid reservoir 12 for more completely emptying the container 14. The base 20 includes a vent 26 communicating the pump body 30 with the fluid reservoir 12 for venting the fluid reservoir 12 as should be well known to those skilled in the art. The piston 40 is slidably mounted within the pump body 30.

Figure 7:
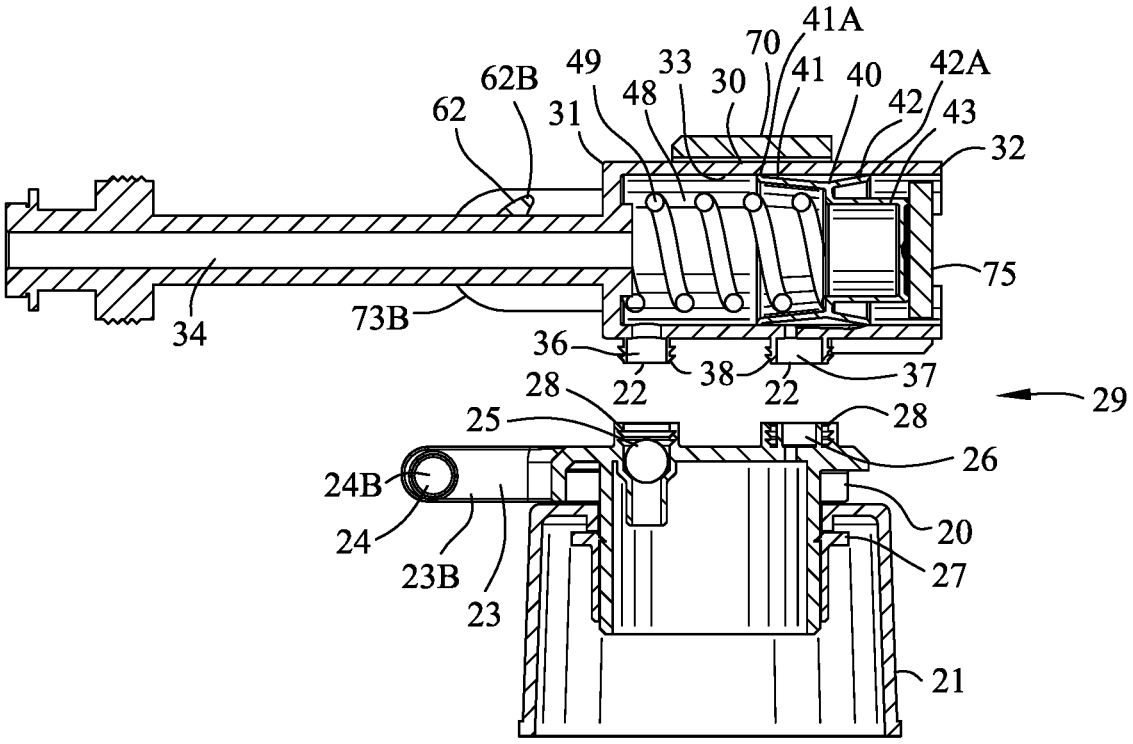
FIG. 7 is an exploded view of FIG. 6 illustrating the separation of a pump body from a base.
Figure 37:
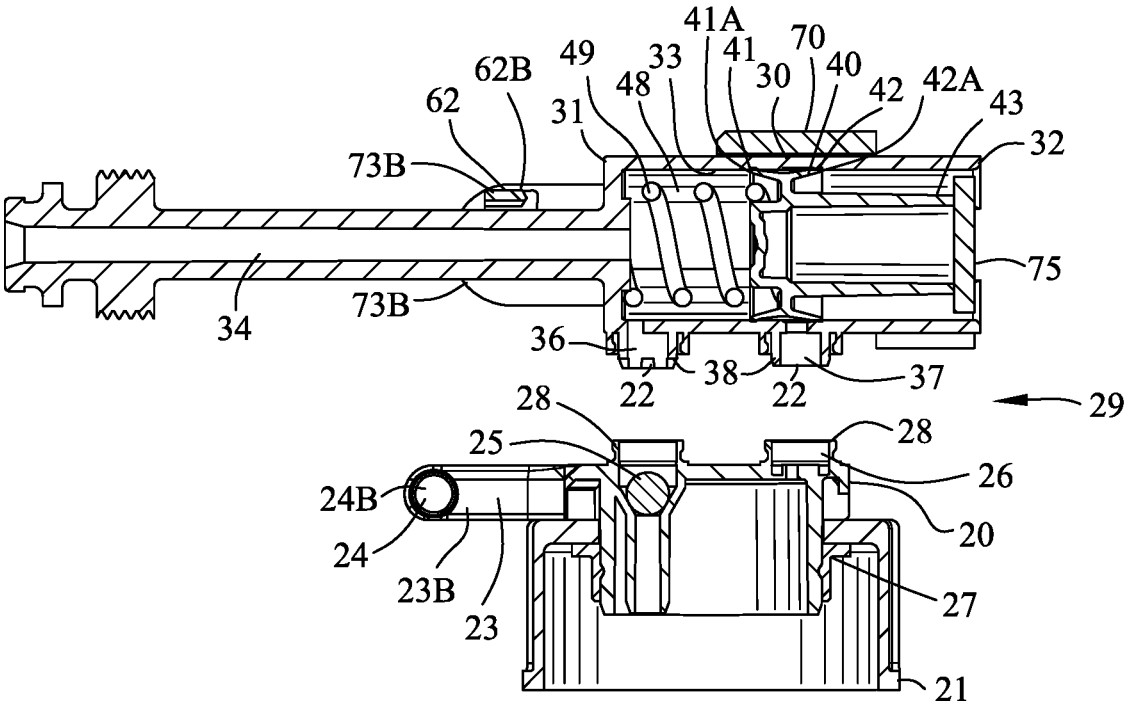
FIG. 37 is an exploded view of FIG. 36 illustrating the separation of a pump body from a base.

FIG. 7 is an exploded view of FIG. 6 illustrating the separation of a pump body 30 from the base 20. FIG. 37 is an exploded view of FIG. 36 illustrating the separation of a pump body 30 from the base 20. In this example, the base connector 22 includes plural deformable locks 38 engaging with the one-way valve 25 and the vent 26 for securing the pump body 30 to the base 20. It should be appreciate by those skilled in the art that various other devices may be used to secure the pump body 30 to the base 20.

Figure 8:
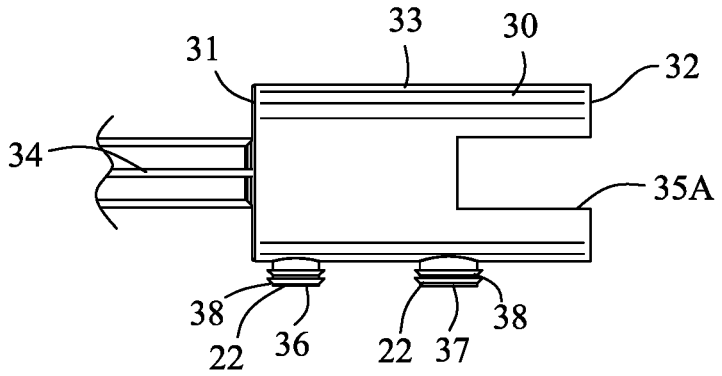
FIG. 8 is a side view of the pump body of FIGS. 1-7.
Figure 9:
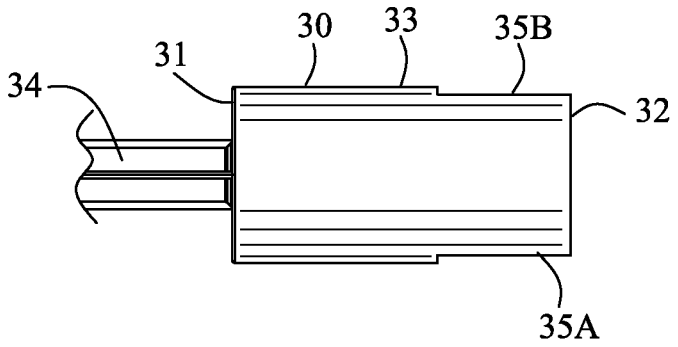
FIG. 9 is a top view of FIG. 8.
Figure 10:
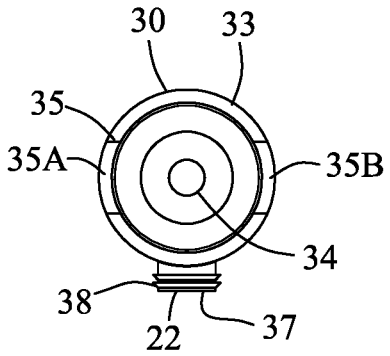
FIG. 10 is a rear view of FIG. 8.
Figure 11:
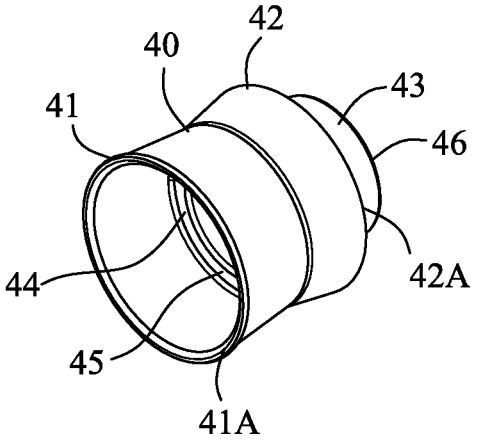
FIG. 11 is an enlarged front isometric view of the piston of the improved pump dispenser of the present invention.
Figure 12:
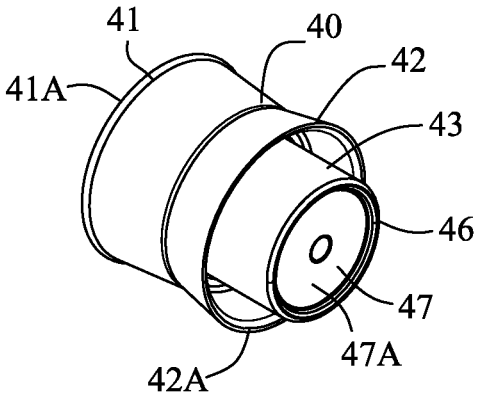
FIG. 12 is an enlarged back isometric view of the piston of FIG. 11.
Figure 14:
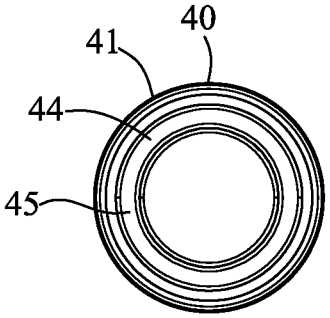
FIG. 14 is a front view of the piston.
Figure 13:
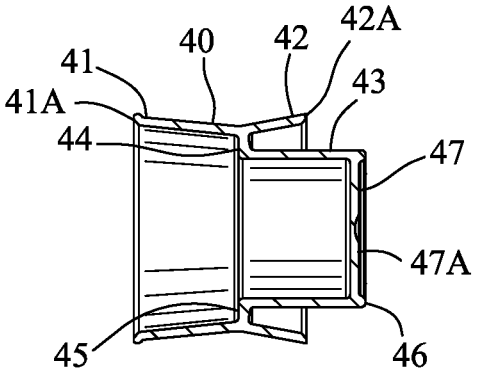
FIG. 13 is a side sectional view of the piston of FIG. 11.
Figure 15:
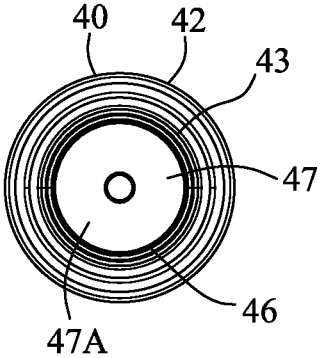
FIG. 15 is a back view of the piston.
Figure 38:
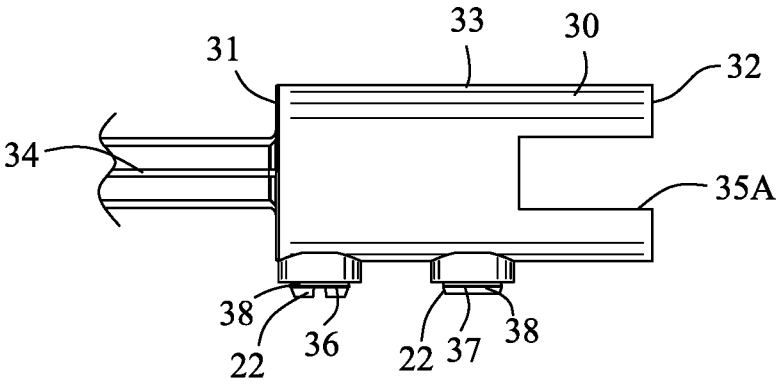
FIG. 38 is a side view of the pump body of FIGS. 31-37.
Figure 39:
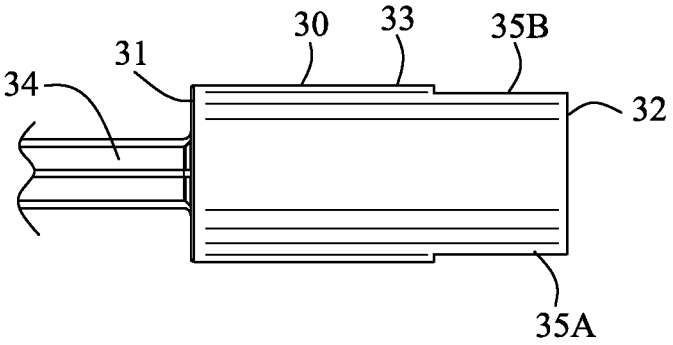
FIG. 39 is a top view of FIG. 38.
Figure 40:
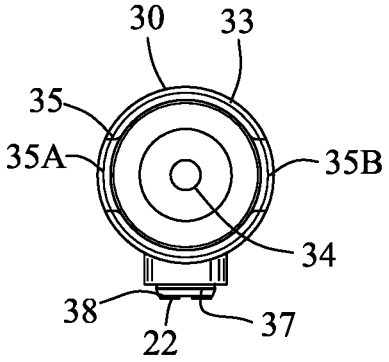
FIG. 40 is a rear view of FIG. 38.
Figure 41:
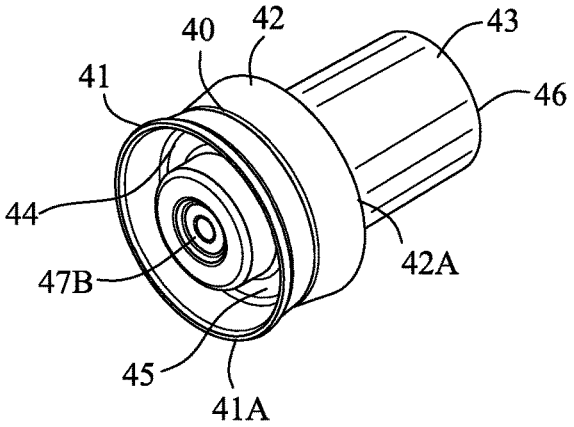
FIG. 41 is an enlarged front isometric view of the piston of the improved pump dispenser of the present invention.
Figure 42:
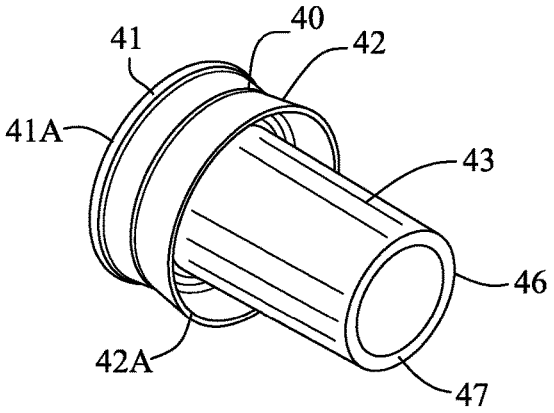
FIG. 42 is an enlarged back isometric view of the piston of FIG. 41.
Figure 43:
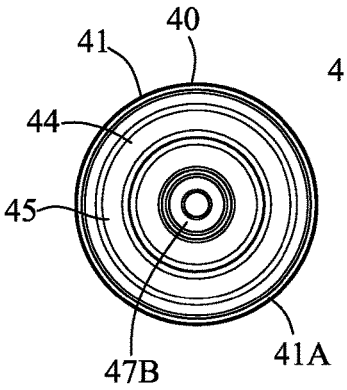
FIG. 43 is a front view of the piston.
Figure 44:
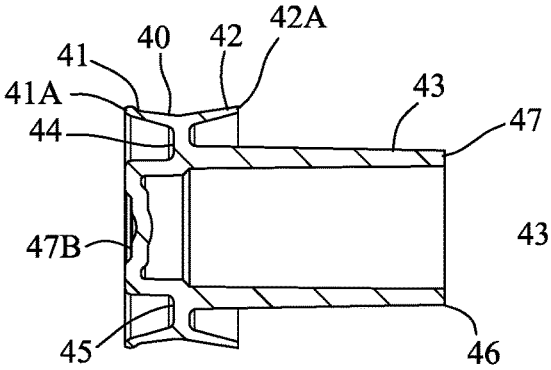
FIG. 44 is a side sectional view of the piston of FIG. 41.
Figure 45:
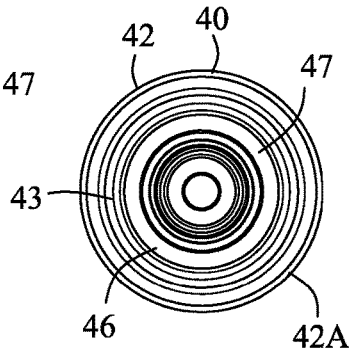
FIG. 45 is a back view of the piston.
Figure 46:
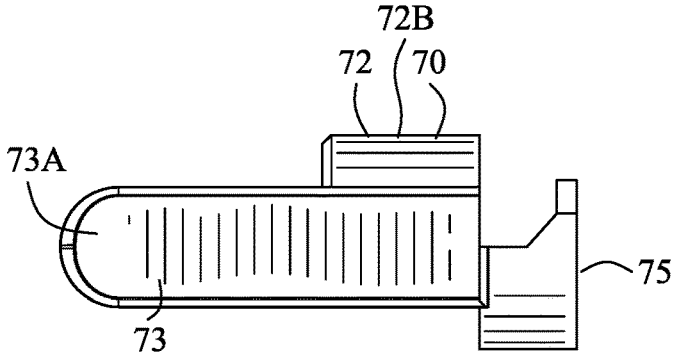
FIG. 46 is a top view of the linkage of FIGS. 32-35.
Figure 47:
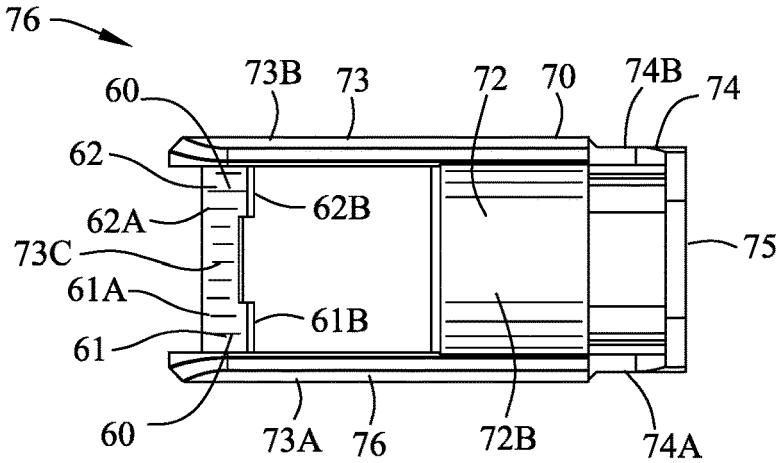
FIG. 47 is a side view of FIG. 46.
Figure 48:
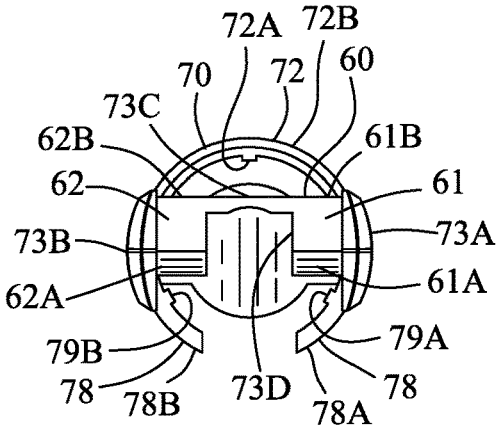
FIG. 48 is a front view of FIG. 46.
Figure 49:
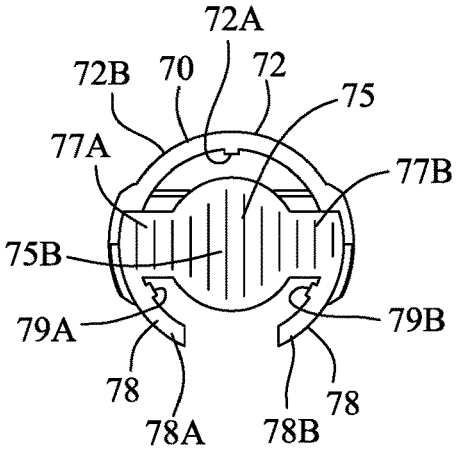
FIG. 49 is a rear view of FIG. 46.
Figure 50:
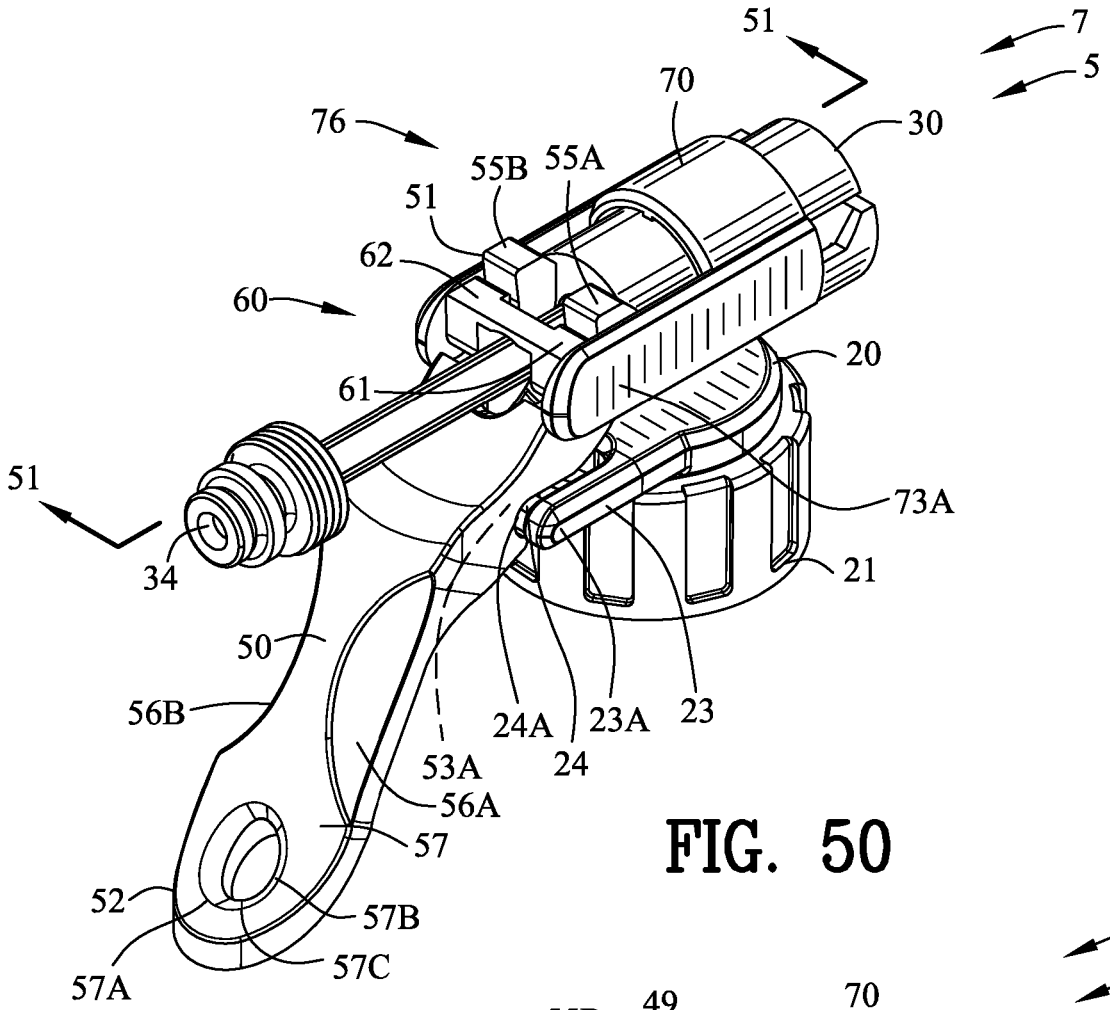
FIG. 50 is an isometric view of the improved pump dispenser of FIG. 32 in an unattended trigger position.
Figure 51:
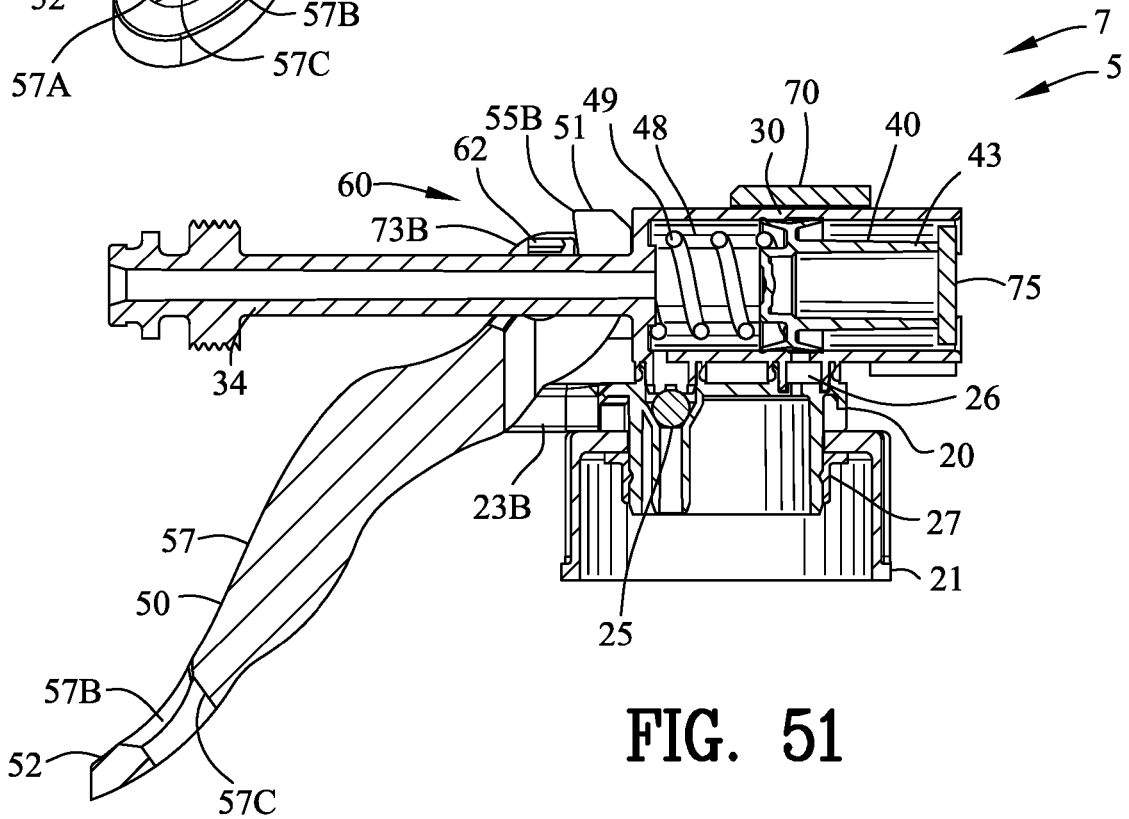
FIG. 51 is a sectional view along line 51-51 in FIG. 50.
Figure 52:
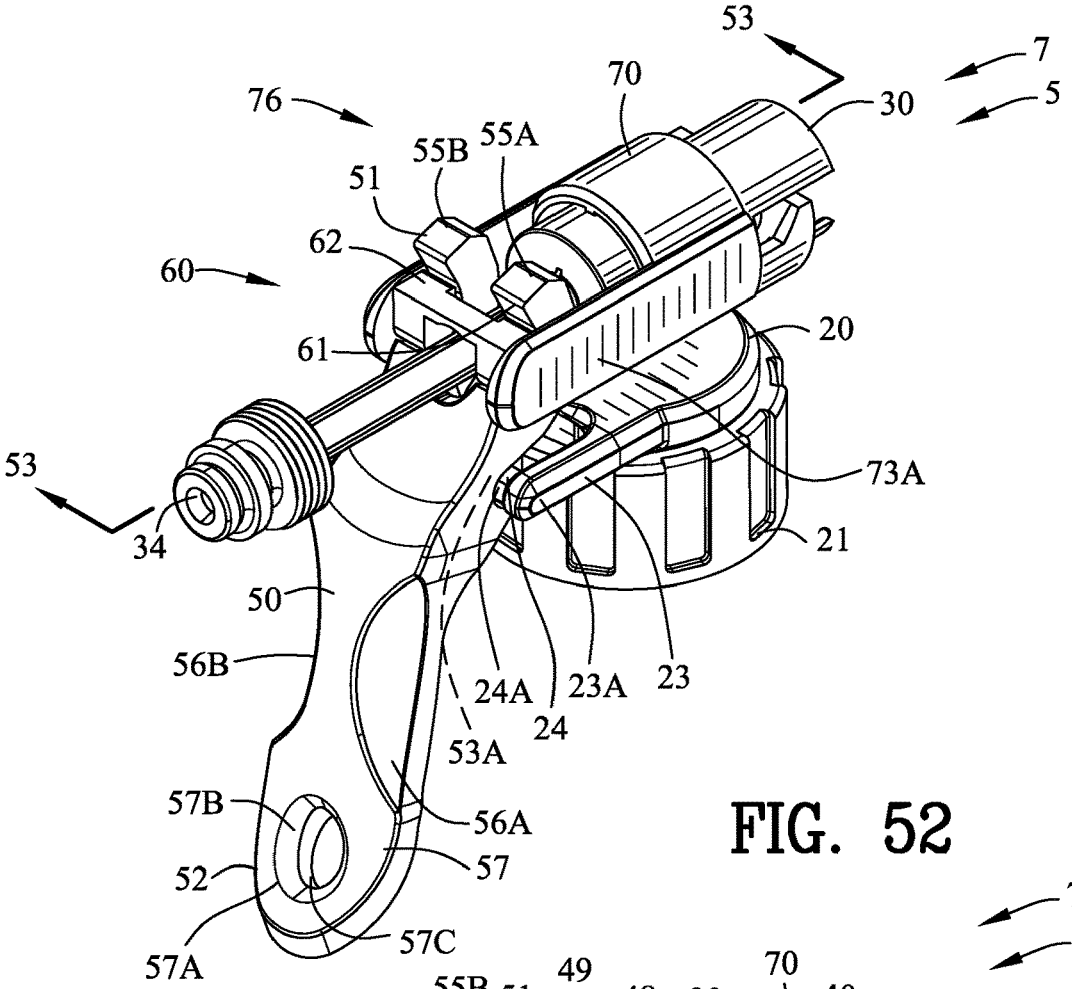
FIG. 52 is an isometric view similar to FIG. 50 with the improved pump dispenser in partially depressed trigger position.
Figure 53:
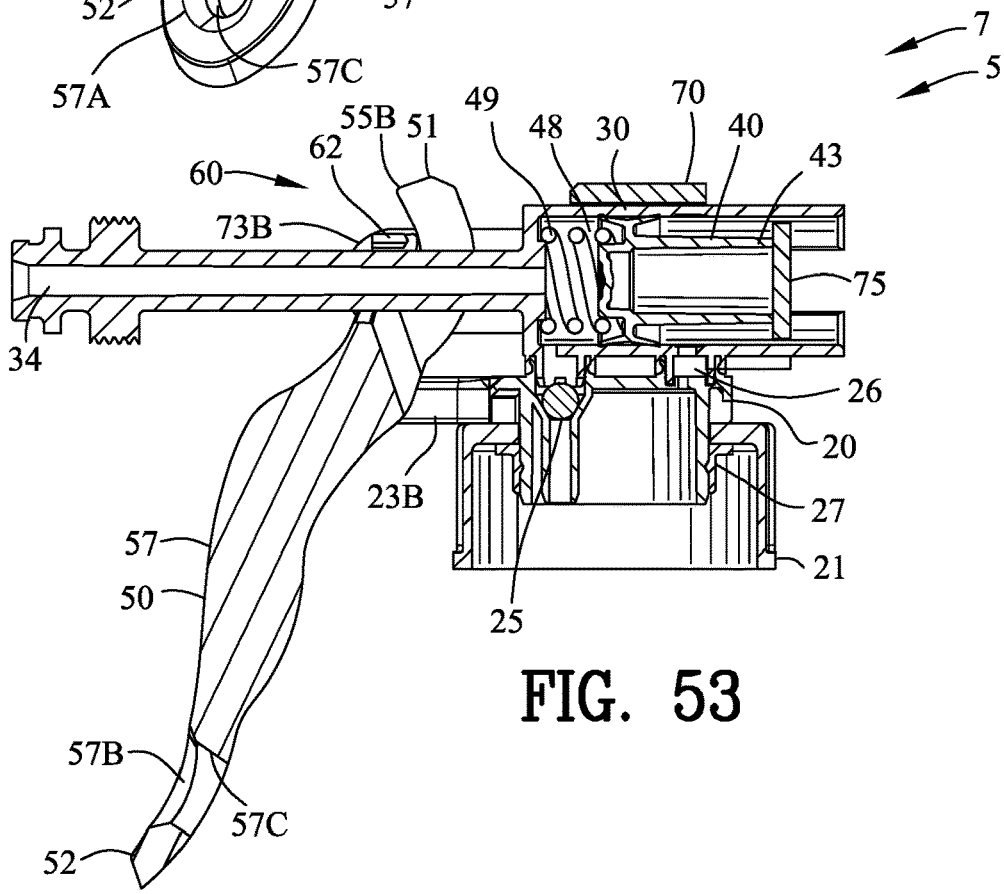
FIG. 53 is a sectional view along line 53-53 in FIG. 52.
Figure 54:
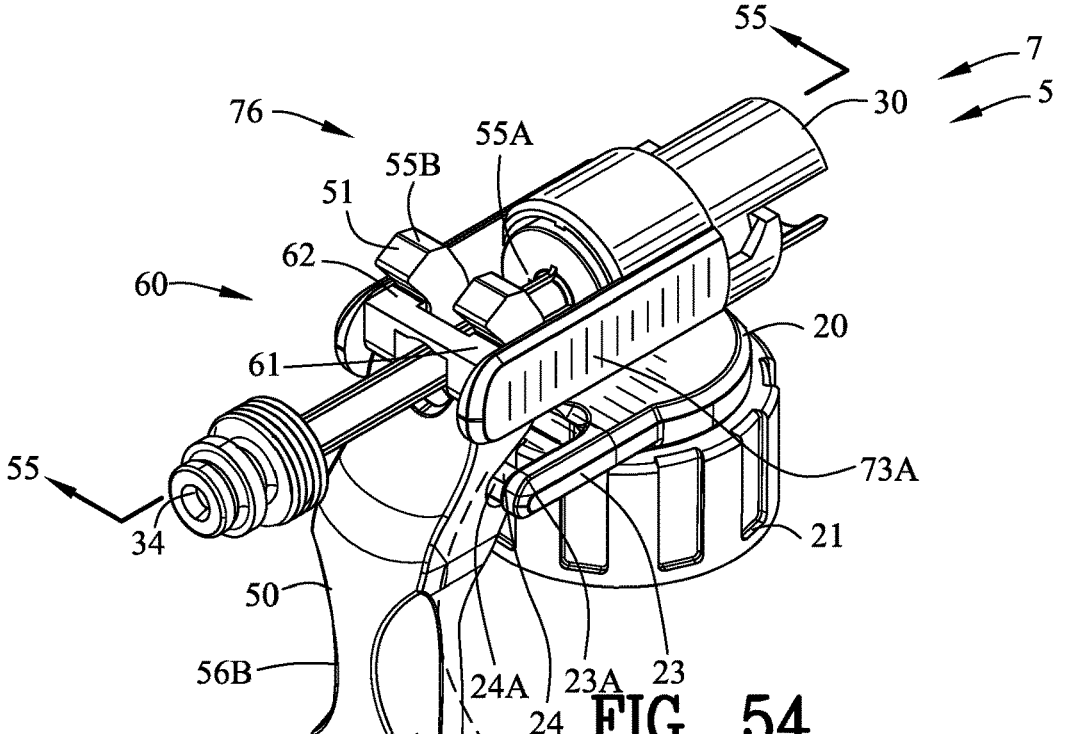
FIG. 54 is an isometric view similar to FIG. 52 with the improved pump dispenser in fully depressed trigger position.
Figure 55:
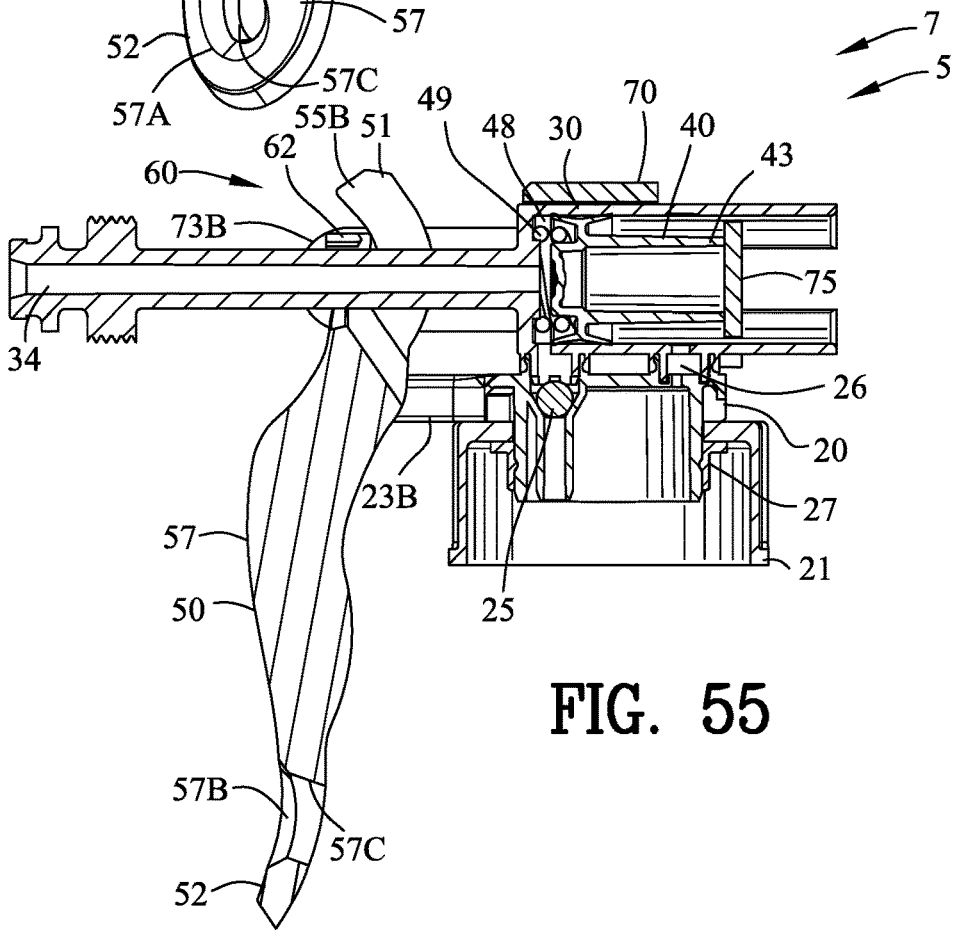
FIG. 55 is a sectional view along line 55-55 in FIG. 54.

FIGS. 8-10 are views of only the pump body 30 of the improved pump dispenser 5 of the present invention shown in FIGS. 1-7. FIGS. 38-40 are views of only the pump body 30 of the improved pump dispenser 5 of the present invention shown in FIGS. 31-37. The pump body 30 extends between a first end 31 and a second end 32 and has a generally cylindrical shape having a sidewall 33.

Figure 3:
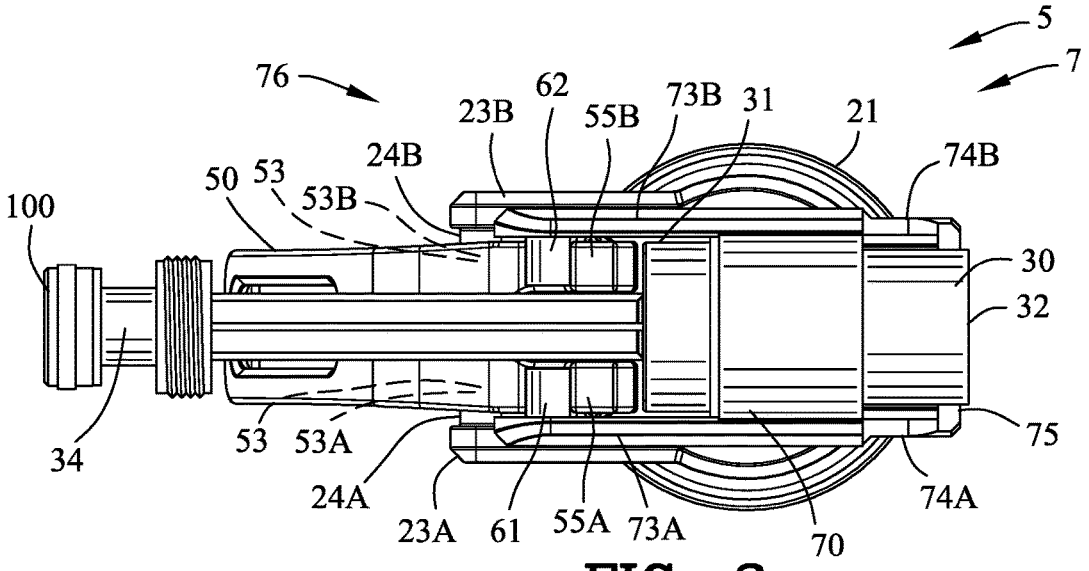
FIG. 3 is a top view of FIG. 2.
Figure 4:
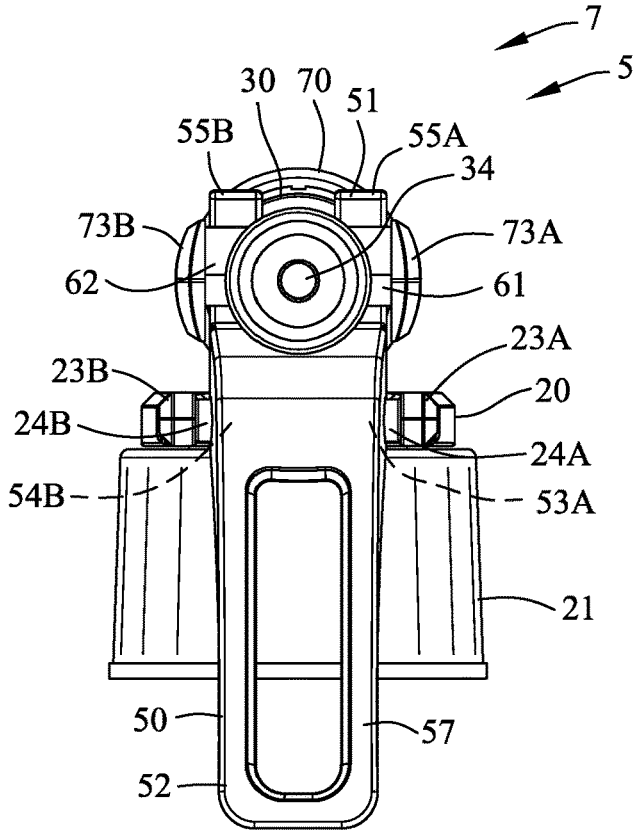
FIG. 4 is a front view of FIG. 2.
Figure 33:
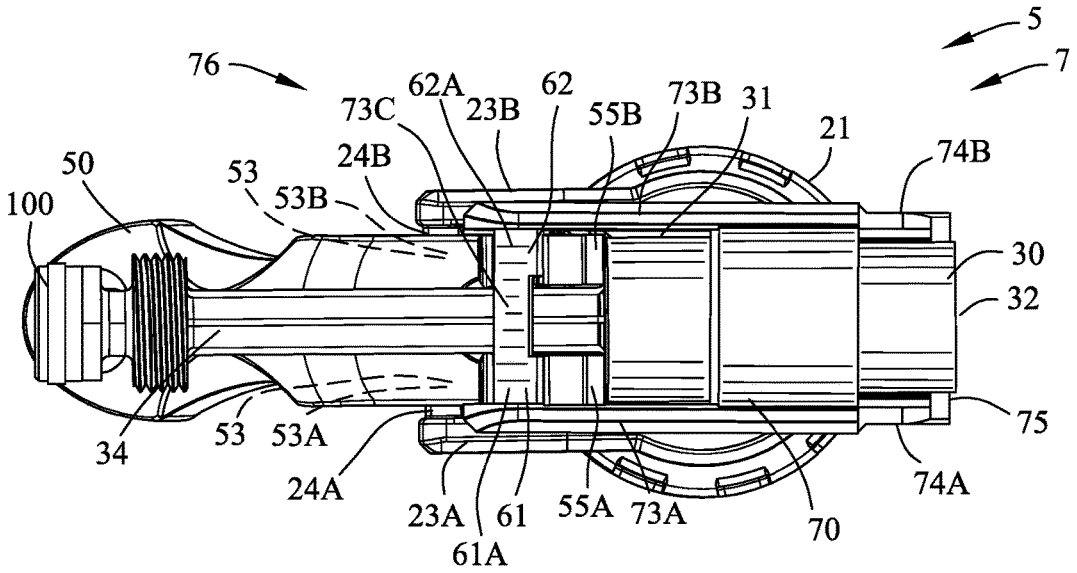
FIG. 33 is a top view of FIG. 32.
Figure 34:
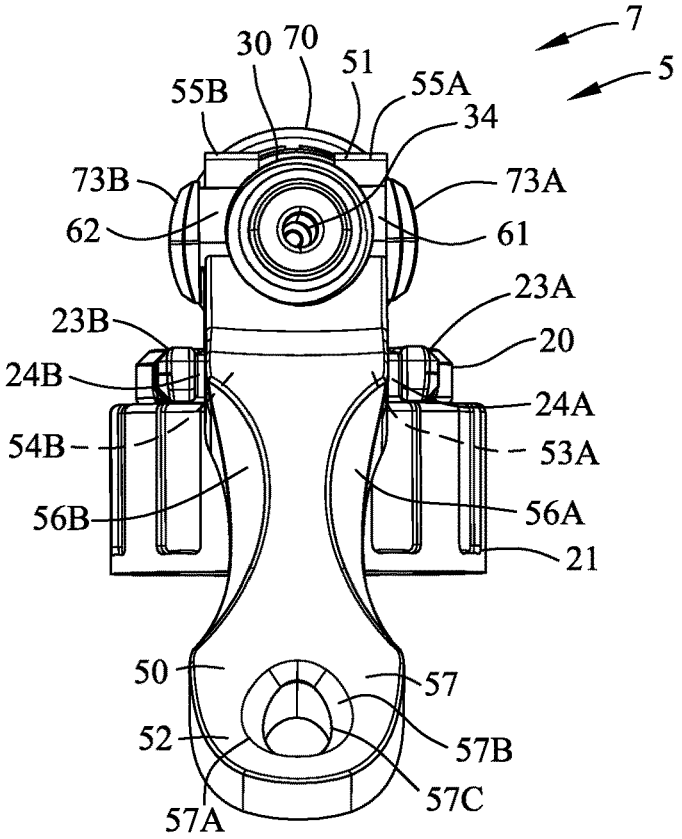
FIG. 34 is a front view of FIG. 32.
Figure 35:
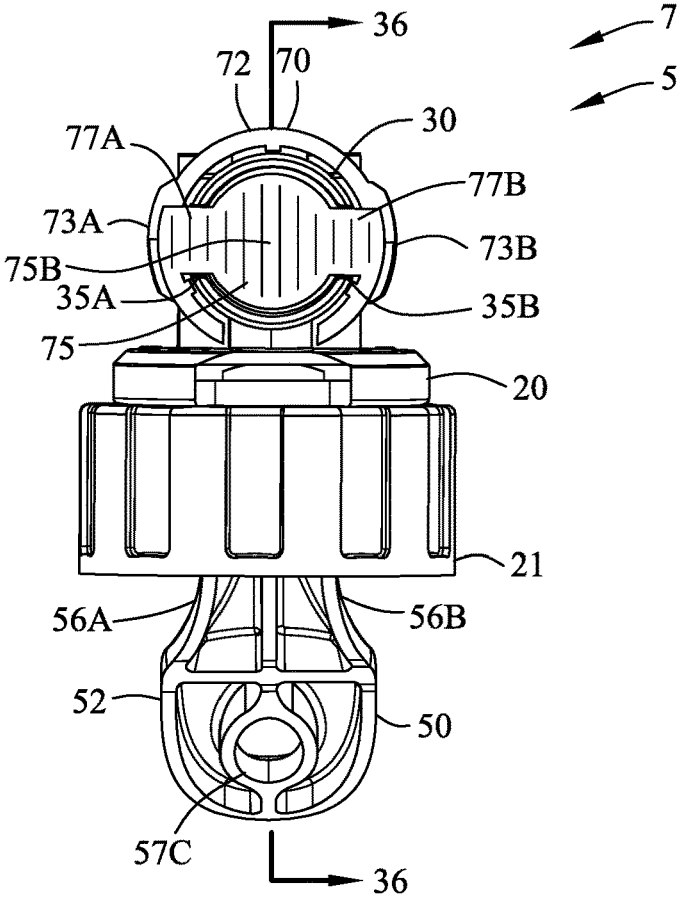
FIG. 35 is a rear view of FIG. 32.

The first end 31 of the pump body 30 is a closed end whereas the second end 32 of the pump body 30 is an open end. A pump body orifice 34 is defined in the closed first end 31 of the pump body 30. As shown in FIGS. 3 and 33, a nozzle check valve 100 is coupled to the pump body orifice 34 for preventing air back into the pump body 30. A slot 35 is defined in the sidewall 33 extending from the second end 32. In this example, a first and a second linear slot 35A and 35B are defined on opposed sides of the pump body 30.

A fluid input port 36 and a vent port 37 are defined in the bottom of the pump body 30. The fluid input port 36 and a vent port 37 are in fluid communication with the one-way valve 25 and the vent 26 of the base 20. The plural deformable locks 38 engage with the one-way valve 25 and the vent 26 for securing the pump body 30 to the base 20 to form the base connectors 22.

FIGS. 11-15 are various views of the piston 40 of the improved pump dispenser 5 of the present invention shown in FIGS. 1-7. FIGS. 41-45 are various views of the piston 40 of the improved pump dispenser 5 of the present invention shown in FIGS. 31-37. The piston 40 comprises a front resilient conical shell 41 and a back resilient conical shell 42. The front and back resilient conical shells 41 and 42 are supported by an inner cylindrical plug 43. A front end 44 of the inner cylindrical plug 43 defines a spring seat 45 whereas the back end of the inner cylindrical plug 43 defines a piston actuator surface 47. Referring back to FIGS. 6 and 36, a piston chamber 48 is defined by the sidewall 33 and the front conical shell 41 of the piston and the first end 31 of the pump body 30. The piston 40 may include a front circular seal 41A located adjacent to the terminal end of the front conical shell 41 and a back circular seal 42A located adjacent to the terminal end of the back conical shell 42. The front circular seal 41A and the back circular seal 42A engage with the interior wall of the sidewall 33 for providing a dual seal for preventing fluid 10 from leaking from the pump body 30.

FIGS. 1-30 and specifically FIGS. 11-15 illustrate the piston 40 including a back piston actuator surface 47A wherein the piston actuator surface 47 is located beyond or outside of the back conical shell 42. FIGS. 31-63 and specifically FIGS. 41-45 illustrate the piston 40 including a front piston actuator surface 47B wherein the piston actuator surface 47 is located generally contiguous to the front conical shell 41. The front piston actuator surface 47B provides for a more efficient pump dispenser 2 and actuator for a pump 7 by increasing the compression of the fluid 10 within the body pump 30. In addition, the front piston actuator surface 47B reduces the number of trigger 50 displacements needed to prime the pump body 30.

A return spring 49 is located between the spring seat 45 of the inner cylindrical plug 43 of the piston 40 and the first end 31 of the pump body 30. The return spring 49 biases the piston 40 in an unattended position as shown in FIGS. 6 and 36. A movement of the front conical shell 41 of the piston 40 to the left in FIG. 6 discharges any fluid within the piston chamber 48 through the pump body orifice 34. The linear movement of the piston 40 and the position of the pump body orifice 34 results in a linear fluid path from the piston 40 to the pump body orifice 34.

The movement of the piston 40 to the left in FIGS. 6 and 36, opens the vent port 37 to communicate with the open second end 32 of the pump body 30 thereby venting the fluid reservoir 12. A return movement of the front conical shell 41 of the piston 40 to the right and to the unattended position as shown in FIGS. 6 and 36, draws fluid 10 from the fluid reservoir 12 through the one-way valve 25 and the fluid input port 36 to refill the piston chamber 48 with fluid 10.

Referring back to FIGS. 2-5 and 32-35, the trigger 50 extends between a first portion 51 and a second portion 52 with a trigger pivot 53 located therebetween. In this example, the trigger pivot 53 comprises a first and a second pivot hole 53A and 53B located on opposed edges of the trigger 50. The first and second pivot holes 53A and 53B receive the first and second base pivots 24A and 24B mounted on the first and second base arms arm 23A and 23B for pivoting the trigger 50 relative to the base 20.

A cam 55 is located on the first portion 51 of the trigger 50 whereas a finger pad 57 is located on the second portion 52 of the trigger 50. In this example, the cam 55 comprises a first and a second cam 55A and 55B located on opposed edges of the trigger 50. The first and second cams 55A and 55B straddle the pump body orifice 34 defined in the closed first end 31 of the pump body 30.

A cam follower 60 is connected to the piston 40 through a linkage 70. The cam 55 and the cam follower 60 couple the first portion 51 of the trigger 50 with the piston 40 for enabling a depression of the second portion 52 of the trigger 50 to move the piston 40 to spray fluid 10 from the pump body orifice 34.

Figure 16:
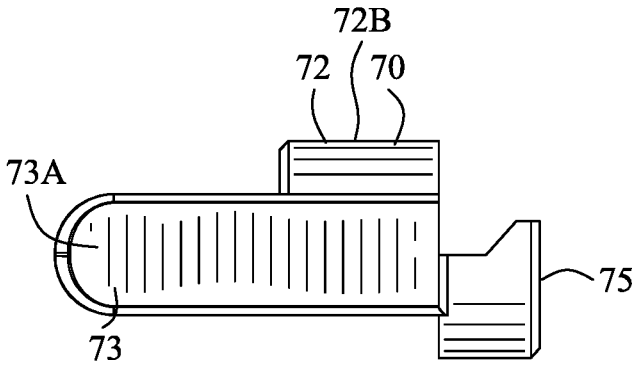
FIG. 16 is a side view of the linkage of FIGS. 2-5.
Figure 17:
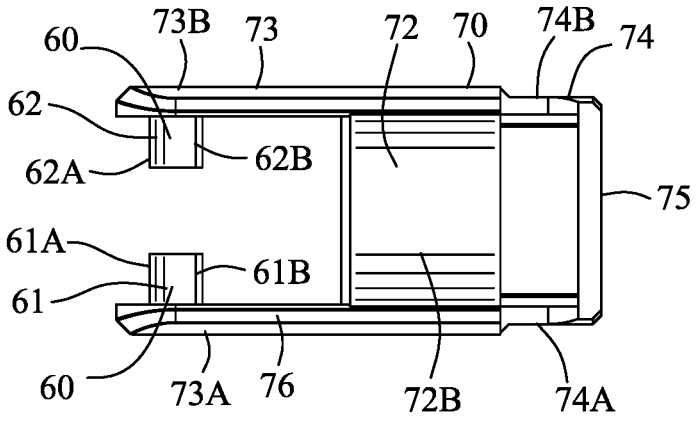
FIG. 17 is a top view of FIG. 16.
Figure 18:
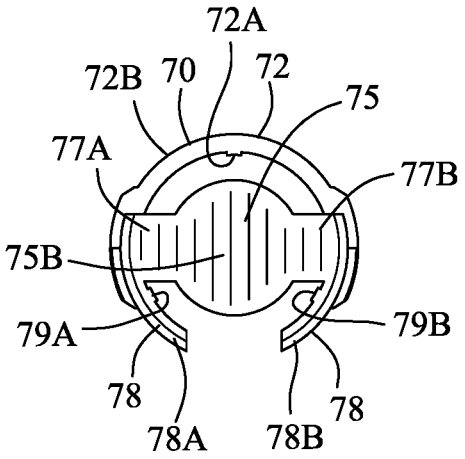
FIG. 18 is a rear view of FIG. 16.
Figure 19:
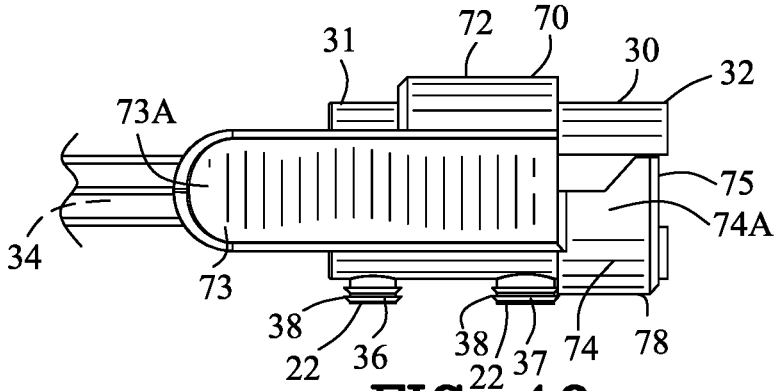
FIG. 19 is a side view of the linkage and pump body of FIGS. 2-5.
Figure 20:
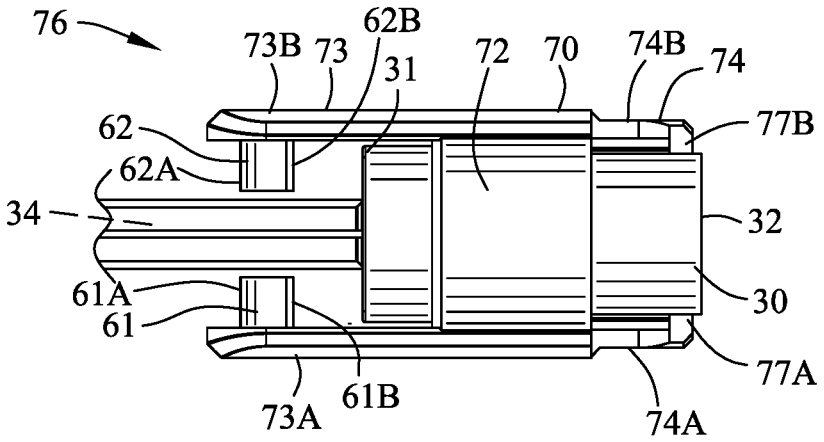
FIG. 20 is a top view of FIG. 19.
Figure 21:
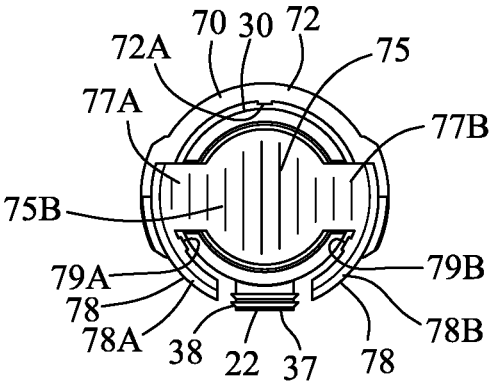
FIG. 21 is a rear view of FIG. 19.
Figure 22:
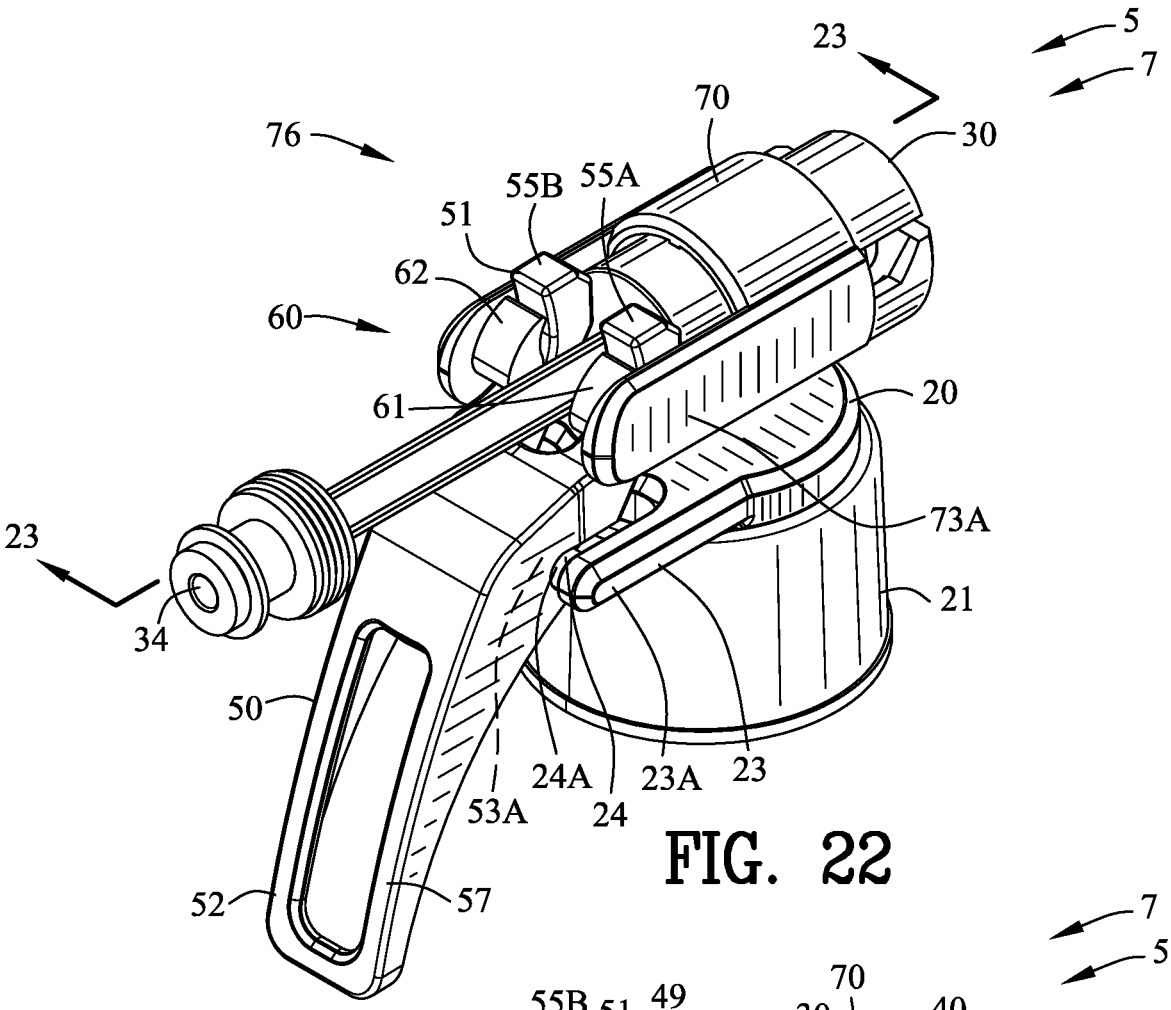
FIG. 22 is an isometric view of the improved pump dispenser of FIG. 2 in an unattended trigger position.

FIGS. 16-18 are various views of the linkage 70 of FIGS. 2-5 connecting the cam follower 60 to the piston 40. FIGS. 46-49 are various views of the linkage 70 of FIGS. 32-35 connecting the cam follower 60 to the piston 40. The linkage 70 may comprise a central cylindrical ring 72 having an inner dimension to slide on an outer surface of the sidewall 33 of the pump body 30. The linkage 70 may further comprise a partial central cylindrical ring 72B having an inner dimension to slide on an outer surface of the sidewall 33 of the pump body 30. A front appendage 73 extends from a forward end of the central cylindrical ring 72 for supporting the cam follower 60. In this example, the front appendage 73 comprises a first and a second front appendage 73A and 73B supporting a first and a second cam follower 61 and 62. The central cylindrical ring 72 and the first and second front appendages 73A and 73B form a generally U-shape linkage 76 straddling opposed sides of the pump body 30.

Preferably, each of the first and second cam followers 61 and 62 comprise plural cam followers including first lower and upper cam followers 61A and 61B and second lower and upper cam followers 62A and 62B.

A back appendage 74 extends from a back end of the central cylindrical ring 72 for supporting a piston actuator 75. In this example, the back appendage 74 comprises a first and a second back appendage 74A and 74B supporting the piston actuator 75. The piston actuator 75 is shown as a generally circular plate 75B located between the first and second back appendages 74A and 74B.

FIGS. 2-7 and 19-30 are various views of the linkage 70 slidably mounted on the pump body 30. FIGS. 32-37 and 50-58 are various views of the linkage 70 slidably mounted on the pump body 30. The diameter of the piston actuator 75 is less than the inner diameter of the inner sidewall 33 of the pump body 30 enabling the piston actuator 75 to enter the pump body 30 to engage with the piston actuator surface 47 to move the piston 40 therein. The piston actuator 75 is secured to the first and second back appendages 74A and 74B by a first and a second guide 77A and 77B. The first and second guides 77A and 77B slide within the first and second linear slots 35A and 35B defined in the pump body 30 in a linear motion.

The first and second back appendages 74A and 74B also support a lower retainer 78. The lower retainer 78 is partially cylindrical having an inner cylindrical dimension configuration to slide on an outer bottom surface of the sidewall 33 of the pump body 30. More specifically, the lower retainer 78 may include a first lower retainer 78A and a second lower retainer 78B. The central cylindrical ring 72 in combination with the first and second guides 77A and 77B within the first and second linear slots 35A and 35B and the lower retainer 78 insure a linear movement for the linkage and the cam follower 60.

As best shown in FIGS. 5, 18, 21, 35, 48, and 49, the linkage 70 may include an upper guide rib 72A extending into the central cylindrical ring 72. The first lower retainer 78A and the second lower retainer 78B may include a first lower guide rib 79A and a second lower guide rib 79B respectively. The upper guide rib 72A, the first lower guide rib 79A and the second lower guide rib 79B slidably engage the central cylindrical ring 72 for distancing the central cylindrical ring 72 from the pump body 30. The upper guide rib 72A, the first lower guide rib 79A and the second lower guide rib 79B assist in providing and directing the linear movement of the linkage 70 relative to the pump body 30 and assist in preventing binding between the linkage 70 and the pump body 30.

FIGS. 31-63 and specifically FIGS. 46-49 illustrate the linkage 70 including an appendage coupling member 73C extending between the first front appendage 73A and the second front appendage 73B. The appendage coupling member 73C assists in preventing the first front appendage 73A and the second front appendage 73B from diverging upon the actuation of the pump dispenser 5 and the actuator 7. More specifically, the appendage coupling member 73C assist in maintaining a constant distance between the first front appendage 73A and the second front appendage 73B along the length of the first front appendage 73A and the second front appendage 73B. By preventing the separation of the first front appendage 73A and the second front appendage 73B the efficiency of the pump body 30 is improved.

FIGS. 31-63 and specifically FIGS. 46-49 also illustrate the appendage coupling member 73C, the first cam follower 61 and the second cam follower 62 defining a coupling member groove 73D. The coupling member groove 73D partially encircles the pump body orifice 34 to further assist in maintaining and directing the linear displacement of the linkage 70 relative to the body 30 and assist in preventing binding between the linkage 70 and the pump body 30.

FIGS. 22-23 and 50-51 illustrate the improved pump dispenser 5 in an unattended trigger position. The cam 55 and the cam follower 60 couple the first portion 51 of the trigger 50 with the piston 40 through the linkage 70 for enabling a depression of the second portion 52 of the trigger 50 to move the piston 40 to spray fluid 10 from the pump body orifice 34. The first portion 51 of the trigger 50 engages an outside surface of the first end 31 of the pump body 30 providing a stop for the movement of the piston 40 to the right in FIGS. 23 and 51 through the urging of the return spring 49.

FIGS. 24-25 and 52-53 illustrate the improved pump dispenser 5 in partially depressed trigger position. The cam 55 and the cam follower 60 transform the pivoting movement of the trigger 50 into a linear movement of the linkage 70. The linear movement of the linkage 70 is coupled to the linear movement of the piston 40 to spray fluid 10 from the pump body orifice 34.

FIGS. 26-27 and 54-55 illustrate the improved pump dispenser 5 in fully depressed trigger position. The pivoting of the trigger 50 moves the piston against the bias of the return spring 49 for spraying the fluid 10 from the pump body orifice 34. The pivoting of the trigger 50 is limited by the tension of the return spring 49 between the piston 40 and the first end 31 of the pump body 30.

Figure 23:
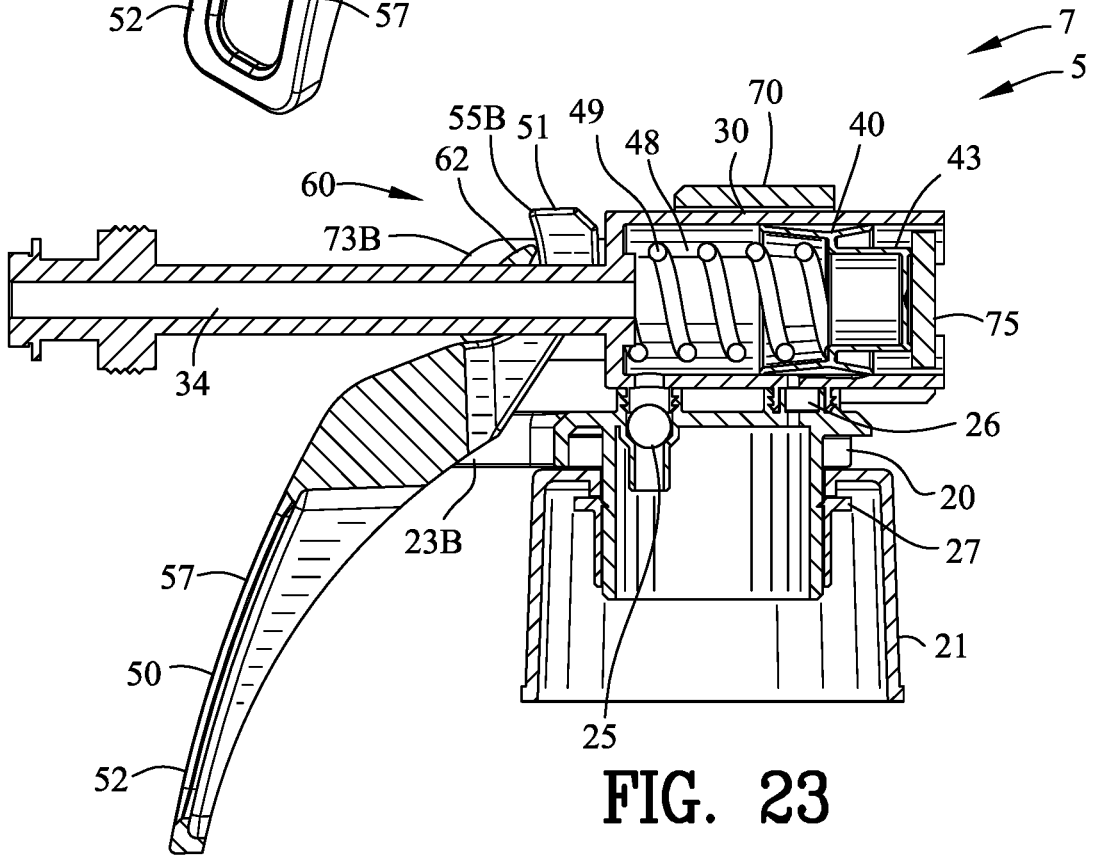
FIG. 23 is a sectional view along line 23-23 in FIG. 22.
Figure 24:
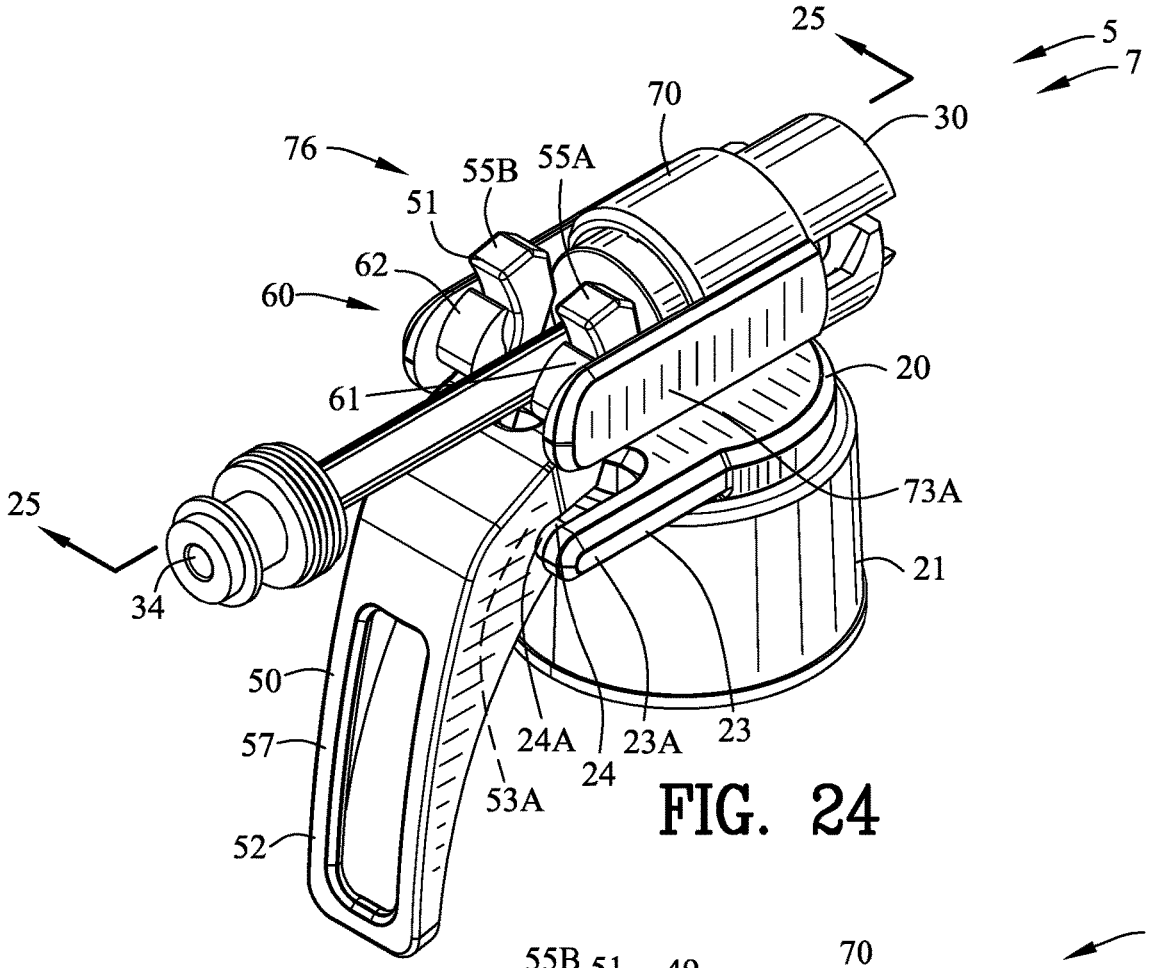
FIG. 24 is an isometric view similar to FIG. 22 with the improved pump dispenser in partially depressed trigger position.
Figure 28:
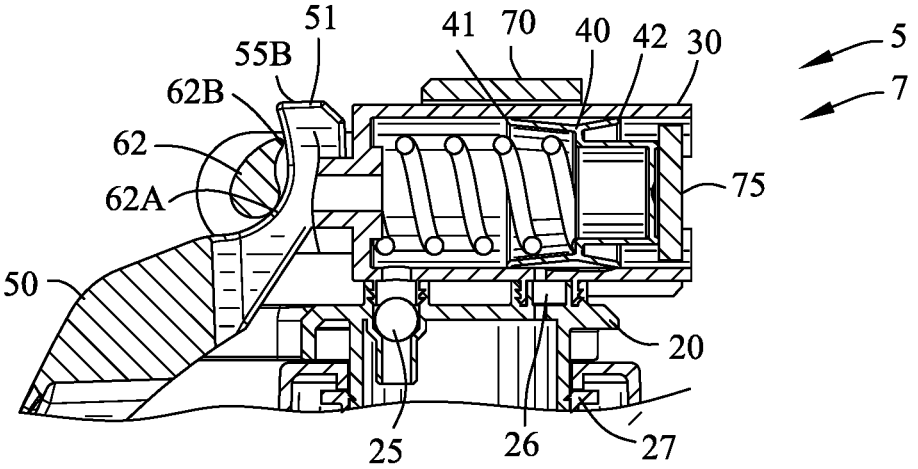
FIG. 28 is an enlarged view of a portion of FIG. 23.
Figure 56:
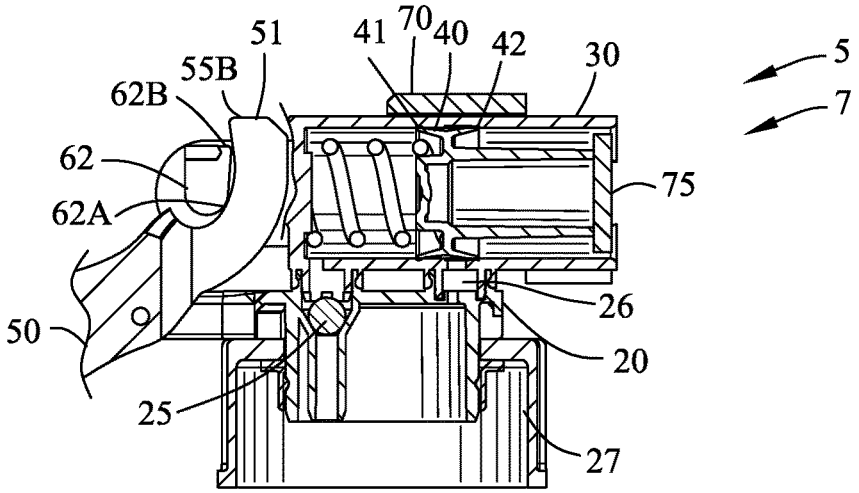
FIG. 56 is an enlarged view of a portion of FIG. 51.

FIG. 28 is an enlarged view of a portion of FIG. 23 in the unattended trigger position. FIG. 56 is an enlarged view of a portion of FIG. 51 in the unattended trigger position. The second lower and upper cam followers 62A and 62B engage with the second cam 55B with a similar engagement occurring between the first lower and upper cam followers 61A and 61B and the first cam 55A.

Figure 25:
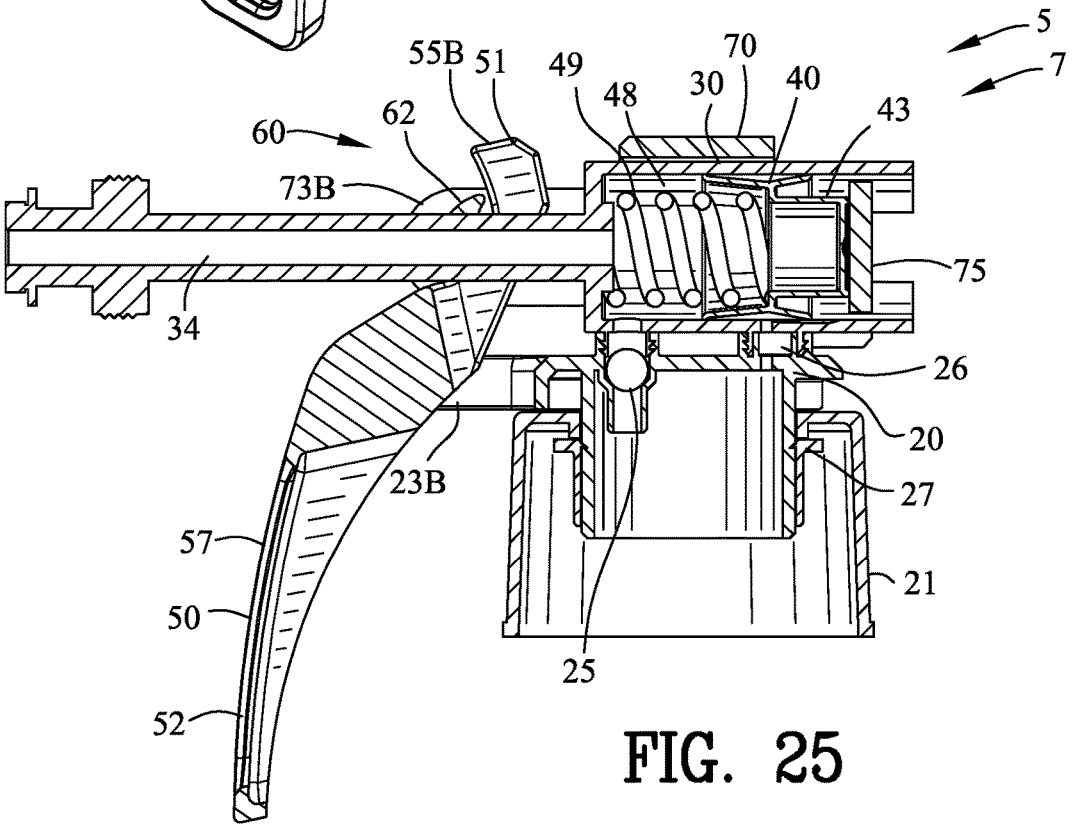
FIG. 25 is a sectional view along line 25-25 in FIG. 24.
Figure 26:
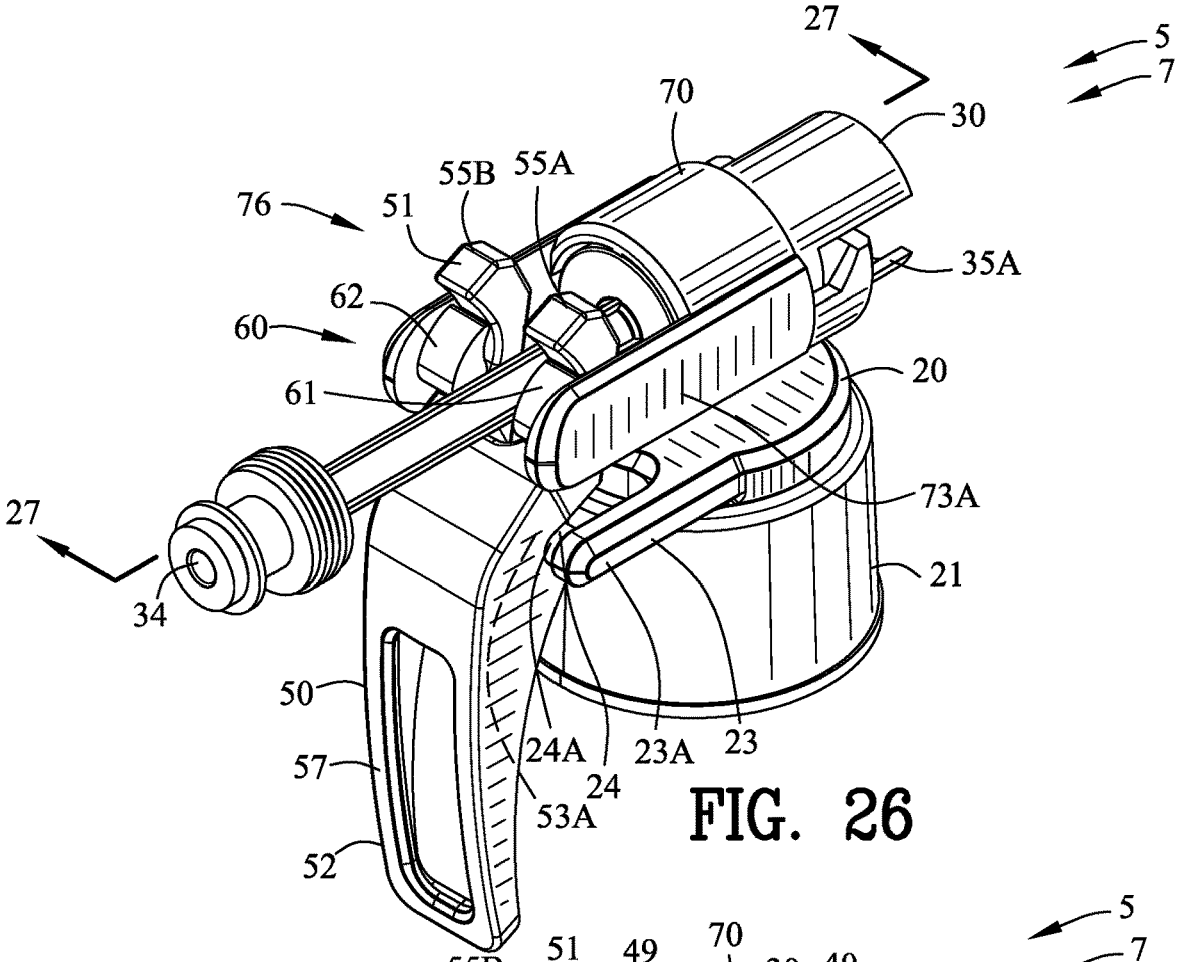
FIG. 26 is an isometric view similar to FIG. 24 with the improved pump dispenser in fully depressed trigger position.
Figure 29:
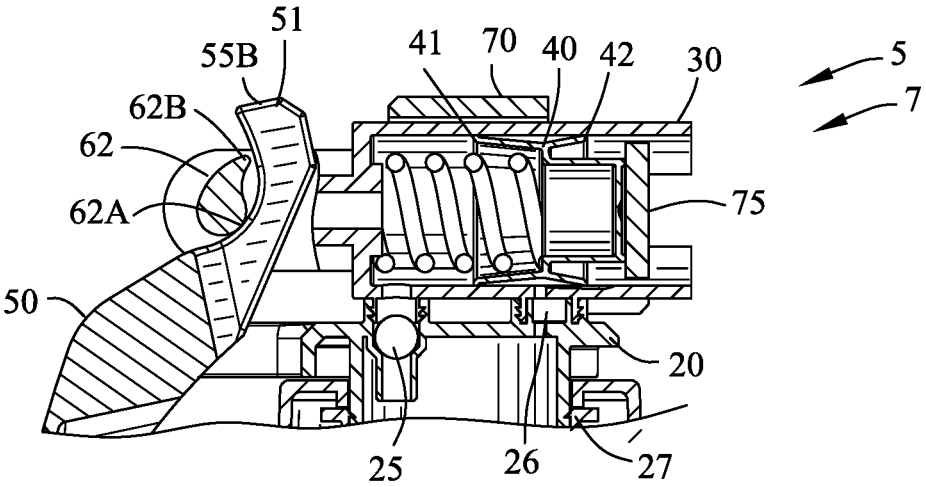
FIG. 29 is an enlarged view of a portion of FIG. 25.
Figure 57:
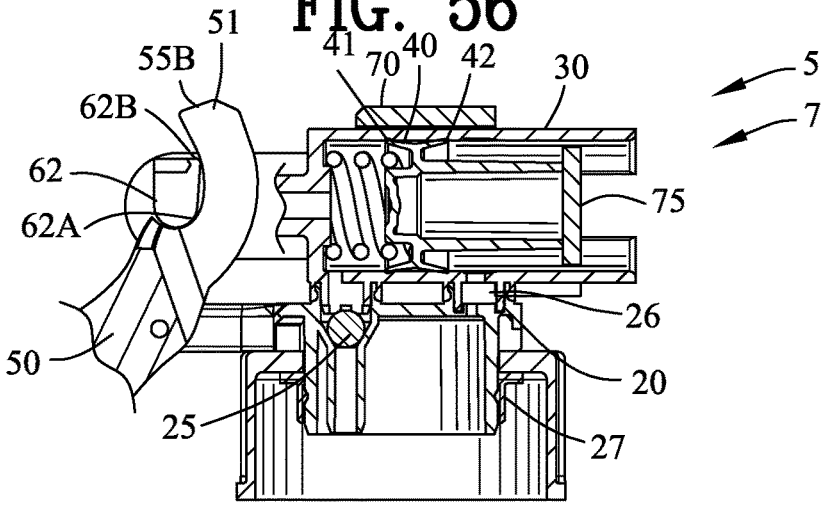
FIG. 57 is an enlarged view of a portion of FIG. 53.

FIG. 29 is an enlarged view of a portion of FIG. 25 in partially depressed trigger position. FIG. 57 is an enlarged view of a portion of FIG. 53 in partially depressed trigger position. The second lower and upper cam followers 62A and 62B engage with the second cam 55B in a different orientation. A similar engagement occurs between the first lower and upper cam followers 61A and 61B and the first cam 55A.

Figure 27:
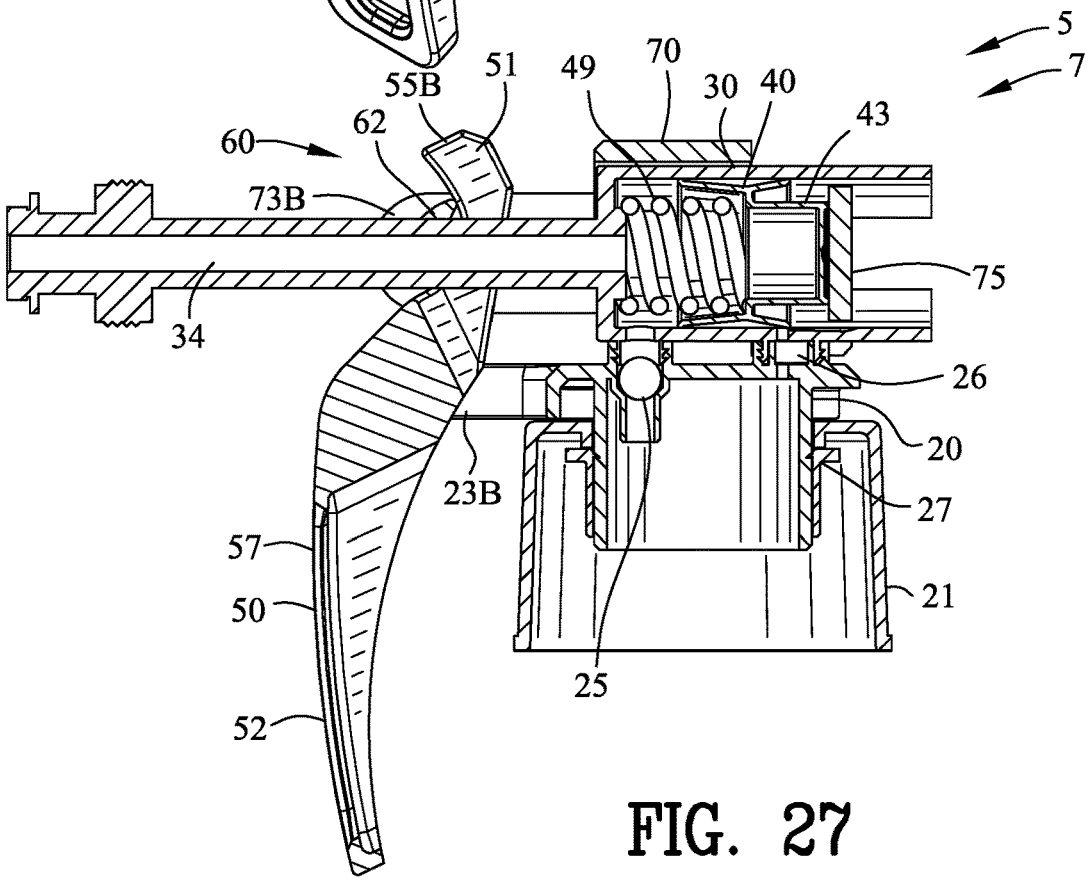
FIG. 27 is a sectional view along line 27-27 in FIG. 26.
Figure 30:
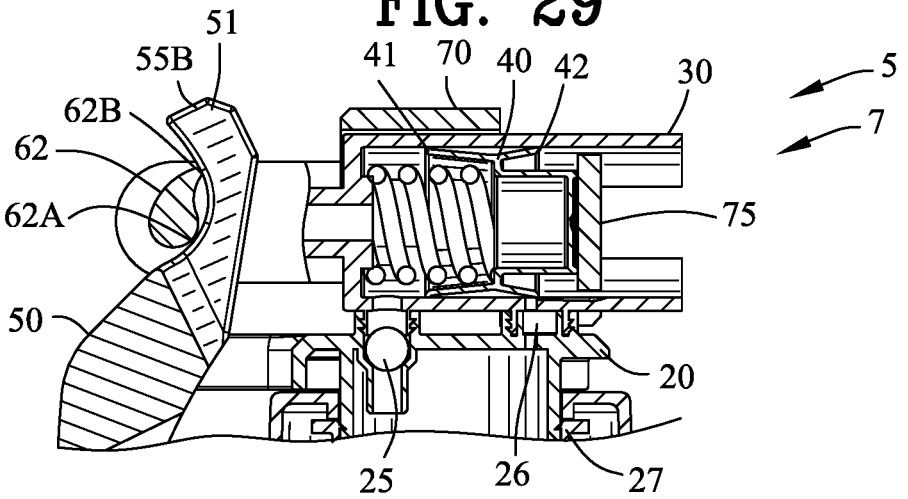
FIG. 30 is an enlarged view of a portion of FIG. 27.
Figure 31:
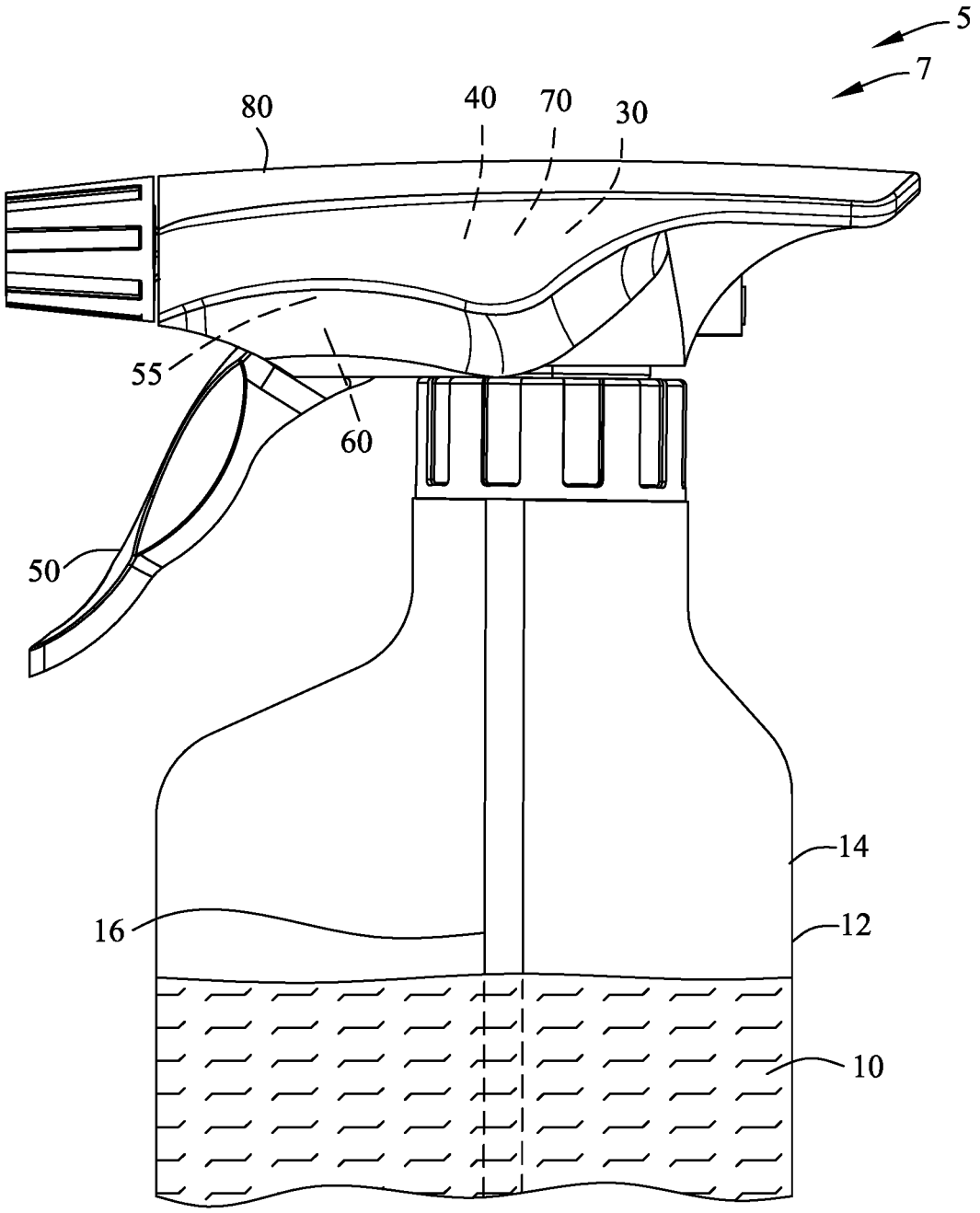
FIG. 31 is side view of a second embodiment of an improved pump dispenser of the present invention.
Figure 32:
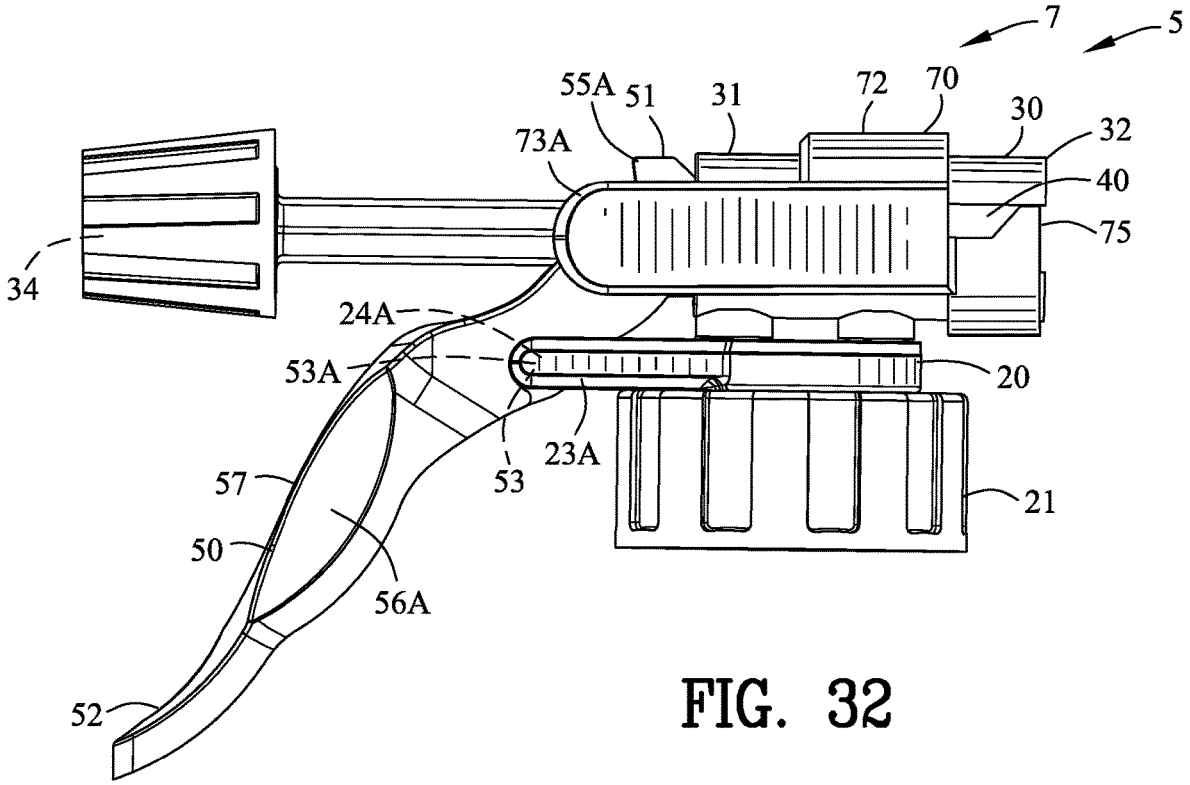
FIG. 32 is side view of the improved pump dispenser of FIG. 31 with a decorative cover removed.
Figure 58:
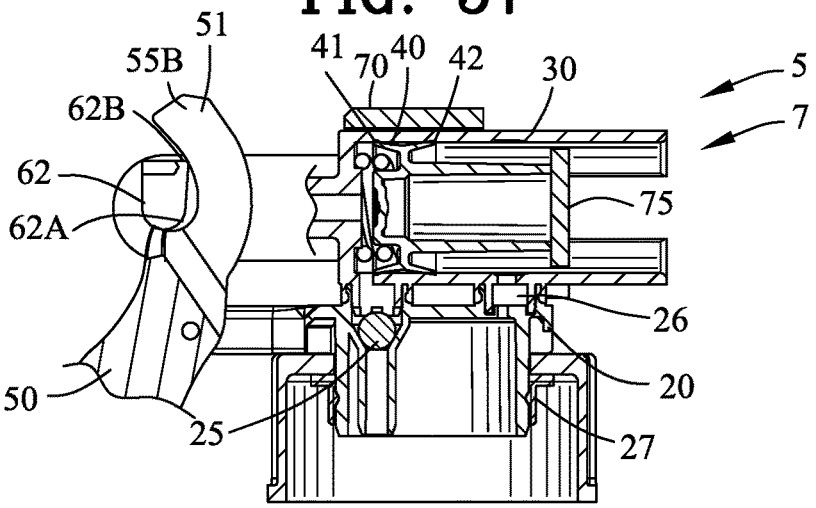
FIG. 58 is an enlarged view of a portion of FIG. 55.

FIG. 30 is an enlarged view of a portion of FIG. 27 in fully depressed trigger position. FIG. 58 is an enlarged view of a portion of FIG. 55 in fully depressed trigger position. The second lower and upper cam followers 62A and 62B engage with the second cam 55B in still a different orientation. A similar engagement occurs between the first lower and upper cam followers 61A and 61B and the first cam 55A. The curvature of the cam 55 in combination with the cam follower 60 translates the rotational movement of the trigger 50 into a linear movement of the linkage 70

Figure 59:
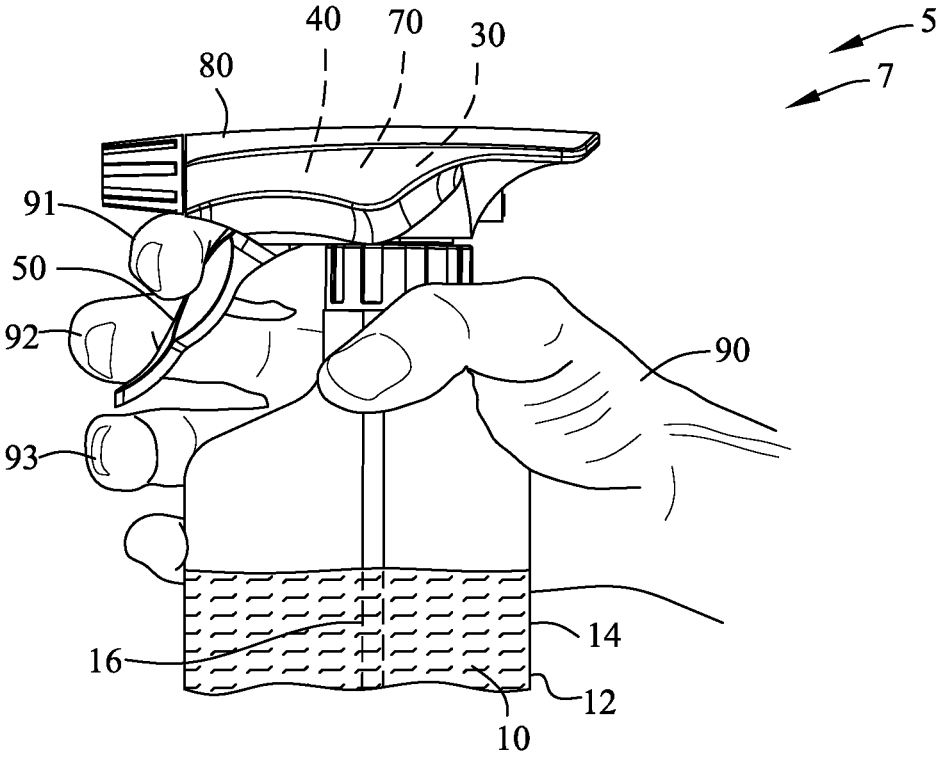
FIG. 59 is a view similar to FIG. 31 illustrating a hand grasping the improved pump dispenser.

FIGS. 31-35, 50-55 and specifically FIGS. 59-60 illustrate the trigger 50 including a first concave tapering recess 56A and a second concave tapering recess 56B. The first concave tapering recess 56A and a second concave tapering recess 56B improve the ergonomics of the trigger by improving the comfort, function and assist in positioning one or more fingers 91, 92, 93 of the hand 90 upon the trigger 50. The first concave tapering recess 56A and the second concave tapering recess 56B assist in aligning one or more fingers 91, 92, 93 of the hand 90 on the trigger 54 at an optimal position to activate the pump dispenser 5 and the actuator 7. For example, FIGS. 59 and 60 illustrate the index finger 91 compressing against the first concave tapering recess 56A and the second concave tapering recess 56B of the trigger 50.

In addition, the trigger 50 may include an outer elliptical aperture 57A adjacent to the exterior surface of the trigger 50. A tapering cylindrical surface 57B is positioned below the outer elliptical aperture 57A. An inner elliptical aperture 57C is positioned below the tapering cylindrical surface 57B. The combination of the outer elliptical aperture 57A, the tapering cylindrical surface 57B and the inner elliptical aperture 57C provide improved ergonomics of the trigger 50 by improving the comfort, function and assist in positioning one or more fingers 91, 92, 93 of the hand 90 upon the trigger 50. The outer elliptical aperture 57A, the tapering cylindrical surface 57B and the inner elliptical aperture 57C assist in aligning one or more fingers 91, 92, 93 of the hand 90 on the trigger 54 at an optimal position to activate the pump dispenser 5 and the actuator 7. FIGS. 59 and 60 illustrate the middle finger 92 compressing against the first concave tapering recess 56A and the second concave tapering recess 56B of the trigger 50. The combination of the first concave tapering recess 56A, the second concave tapering recess 56B, outer elliptical aperture 57A, the tapering cylindrical surface 57B and the inner elliptical aperture 57C assist in positioning one or more fingers 91, 92, 93 of the hand 90 at an optimal position to activate the pump dispenser 5 and the actuator 7.

Figure 61:
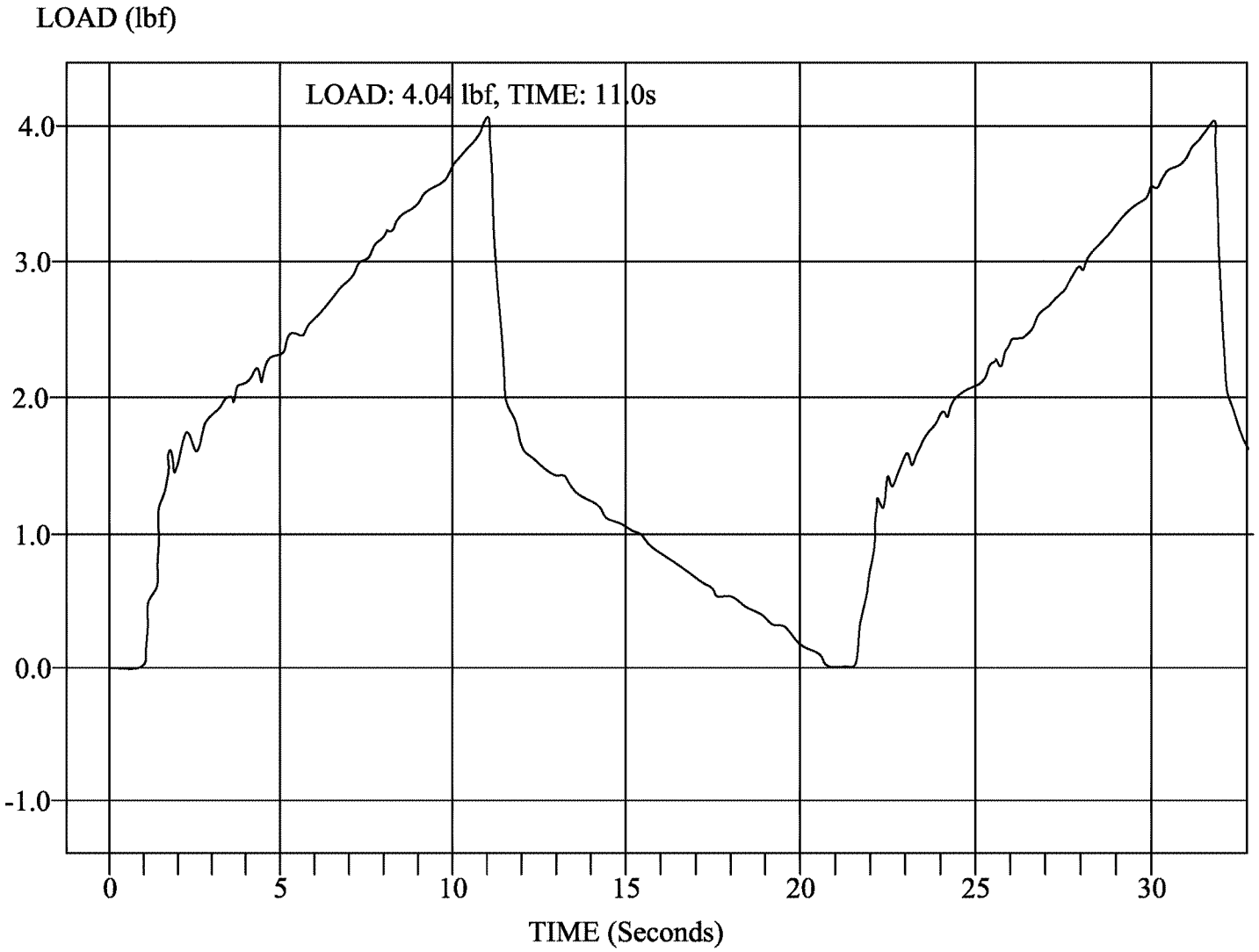
FIG. 61 is a graph illustrating time vs. load for a first other pump dispenser.
Figure 62:
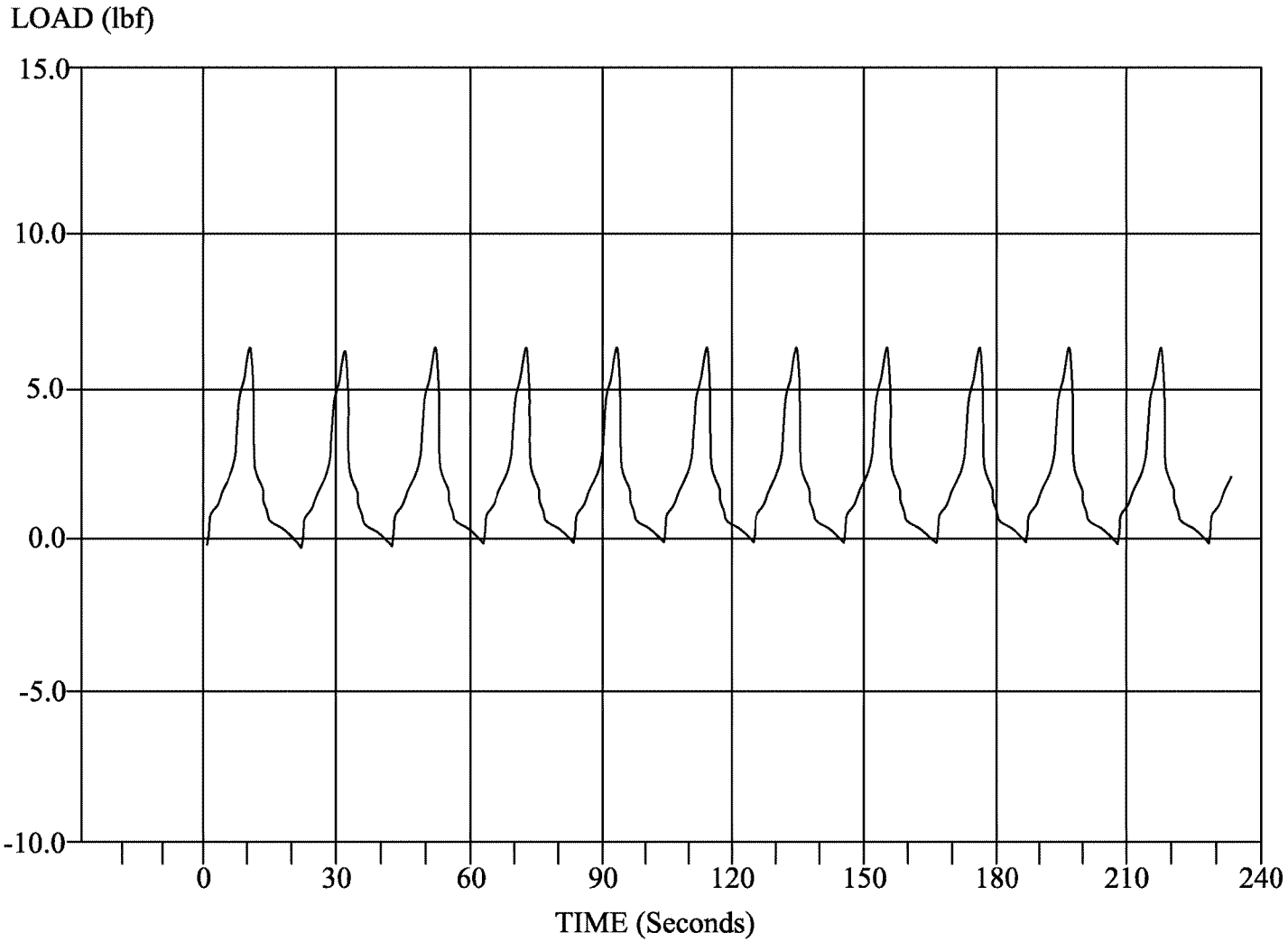
FIG. 62 is a graph illustrating time vs. load for a second other pump dispenser.
Figure 63:
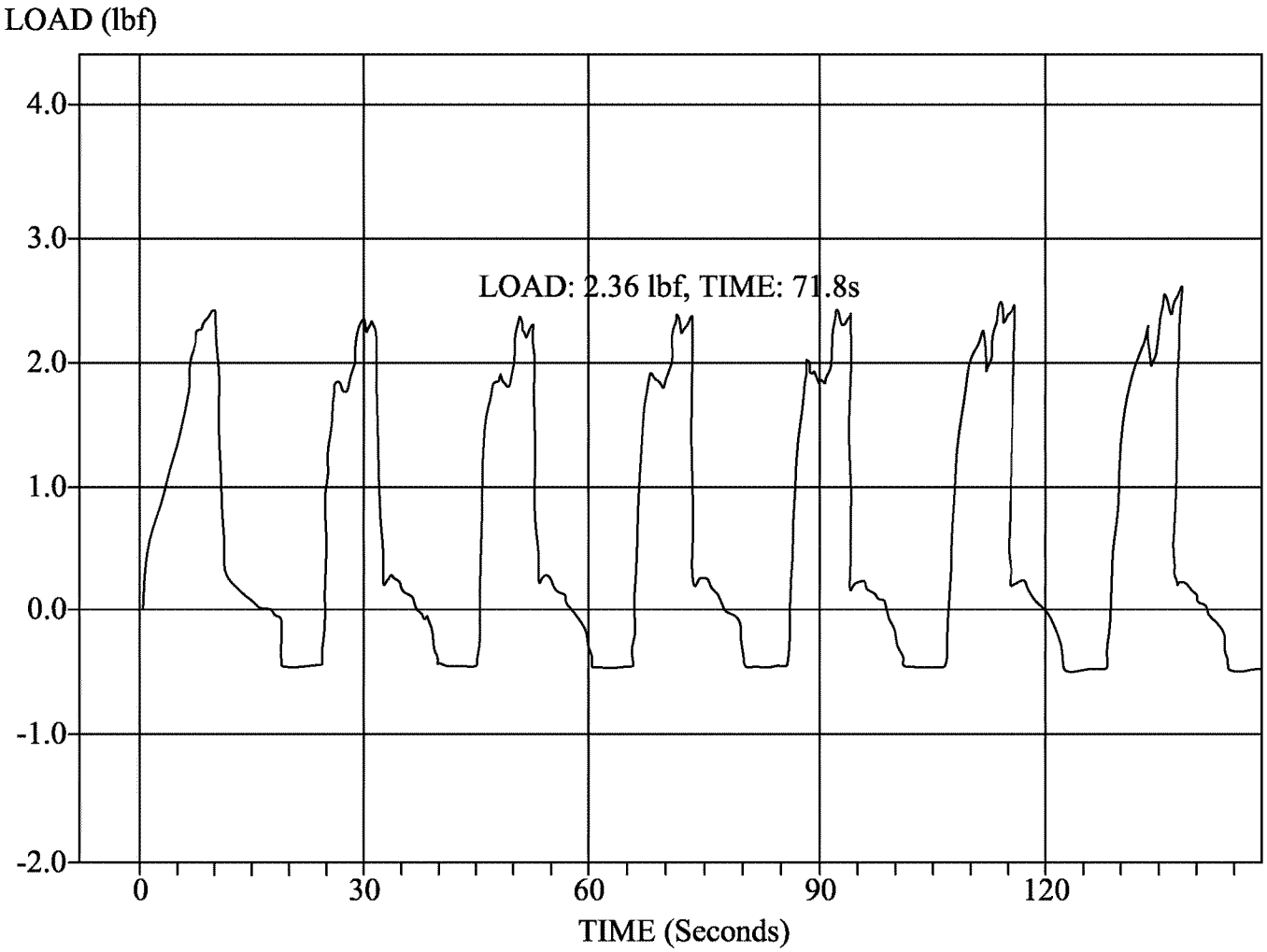
FIG. 63 is a graph illustrating time vs. load for the improved pump dispenser of the present invention.

FIGS. 61 and 62 illustrate graphs of other pump dispensers having time vs. load coordinates. In FIG. 61 the pump dispenser required a maximum load of 4.04 pound-force (lbf) over an eleven (11) second interval. In FIG. 62 the pump dispenser required a maximum load of over 5 pound-force (lbf) over a ten (10) second interval. FIG. 63 illustrates a graph of the improved pump dispenser 5 and the improved actuator for the pump 7 having time vs. load coordinates. In FIG. 63 the improved pump dispenser 5 and the improved actuator for the pump 7 required a maximum load of 2.36 pound-force (lbf) over a ten (10) second interval.

The present disclosure includes that contained in the appended claims as well as the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved pump dispenser for discharging a fluid from a fluid reservoir, comprising:

a pump body extending between a first and a second cylindrical end;

a pump body orifice located in said first end of said pump body;

a piston slidably mounted in said pump body;

a base supporting said pump body relative to the fluid reservoir;

a trigger extending a between a first portion and a second portion;

a base pivot pivotably mounting said trigger relative to said base;

a first and a second cam defined in said first portion of said trigger;

a U-shape linkage straddling opposed sides of said pump body for engaging with said piston;

a first and a second cam follower located on a first and a second distal end of said U-shape linkage for coupling with said first and second cams defined in said first portion of said trigger;

said first cam follower having a first lower cam follower and a first upper cam follower;

said second cam follower having a second lower cam follower and a second upper cam follower;

said first lower cam follower and said first upper cam follower engaging with said first cam in difference orientations between an unattended trigger position and a fully depressed trigger position for enabling a pivoting movement of said second portion trigger to move linearly said piston to spray fluid from said pump body orifice; and said second lower cam follower and said second upper cam follower engaging with said second cam in difference orientations between an unattended trigger position and a fully depressed trigger position for enabling said pivoting movement of said second portion trigger to move linearly said piston to spray fluid from said pump body orifice.

2. The improved pump dispenser as set forth in claim 1, wherein each of said first and second cam followers includes plural cam follower projections.

3. The improved pump dispenser as set forth in claim 1, wherein a first and a second linear slot is defined in opposed sides of said pump body; and said U-shape linkage slidably mounted in said first and second linear slots.

4. The improved pump dispenser as set forth in claim 1, further including an appendage coupling member extending between said U-shaped linkage for preventing diverging of said U-shaped linkage upon actuation of said trigger.

5. The improved pump dispenser as set forth in claim 4, further including a coupling member groove defined by said first cam follower, said second cam follower and said appendage coupling member; and said coupling member groove encircling said pump body for further directing the linear displacement of said U-shaped linkage relative to said body.

6. The improved pump dispenser as set forth in claim 1, further including an upper guide rib coupled to said U-shape linkage and extending towards said pump body;

a lower guide rib coupled to said U-shape linkage and extending towards said pump body; and said upper guide rib and said lower guide rib assist in directing the linear movement of said U-shape linkage relative to said pump body and assisting in preventing binding between said U-shape linkage and U-shape pump body.

7. An improved pump dispenser for discharging a fluid from a fluid reservoir, comprising:

a pump body extending between a first and a second cylindrical end;

a pump body orifice located in said first end of said pump body;

a piston slidably mounted in said pump body;

a base supporting said pump body relative to the fluid reservoir;

a trigger extending a between a first portion and a second portion;

a base pivot pivotably mounting said trigger relative to said base;

a first and a second cam defined in said first portion of said trigger;

a linkage engaging with said piston;

a first and a second cam follower located on said linkage for coupling with said first and second cams defined in said first portion of said trigger;

said first cam follower having a first lower cam follower and a first upper cam follower;

said second cam follower having a second lower cam follower and a second upper cam follower;

said first lower cam follower and said first upper cam follower engaging with said first cam in difference orientations between an unattended trigger position and a fully depressed trigger position for enabling a pivoting movement of said second portion trigger to move linearly said piston to spray fluid from said pump body orifice; and said second lower cam follower and said second upper cam follower engaging with said second cam in difference orientations between an unattended trigger position and a fully depressed trigger position for enabling said pivoting movement of said second portion trigger to move linearly said piston to spray fluid from said pump body orifice.

8. The improved pump dispenser as set forth in claim 7, further including an appendage coupling member extending between said linkage for preventing diverging of said linkage upon actuation of said trigger.

9. The improved pump dispenser as set forth in claim 7, further including a coupling member groove defined by said first cam follower, said second cam follower and said appendage coupling member; and said coupling member groove encircling said pump body for further directing the linear displacement of said linkage relative to said body.

10. The improved pump dispenser as set forth in claim 7, further including an upper guide rib coupled to said linkage and extending towards said pump body;

a lower guide rib coupled to said linkage and extending towards said pump body; and said upper guide rib and said lower guide rib assist in directing the linear movement of said linkage relative to said pump body and assisting in preventing binding between said linkage and said pump body.

11. An improved pump dispenser as set forth in claim 7, wherein said base connector connects said pump body to said base in a deformable engagement for simplify assembly and changing the appearance of the pump dispenser.

12. An improved pump dispenser as set forth in claim 7, wherein said base connector connects said pump body to said base in a deformable engagement for allowing the use of multiple styles and types of nozzle designs to change the spray characteristics of the pump dispenser.

13. An improved pump dispenser as set forth in claim 7, wherein said base connector connects said pump body to said base in a deformable engagement for allowing the use multiple styles of trigger elements to change the appearance, actuation forces and ergonomics of the pump dispenser.

14. The improved pump dispenser as set forth in claim 7, including a return spring for biasing said piston in an unattended position, a pivot of said trigger moving said piston against the bias of said spring for spraying a fluid from said pump body orifice.

15. The improved pump dispenser as set forth in claim 7, wherein said base connector secures the pump body to said base enabling the interchange of different pump bodies.

16. The improved pump dispenser as set forth in claim 7, including a hood for covering the pump body for changing the appearance of the pump dispenser.

17. The improved pump dispenser as set forth in claim 7, including an arm extending from said base; and said base pivot mounted on said arm for pivoting said trigger.

18. An improved pump dispenser for discharging a fluid from a fluid reservoir, comprising:

a pump body extending between a first and a second cylindrical end;

a pump body orifice located in said first end of said pump body;

a piston slidably mounted in said pump body;

a base supporting said pump body relative to the fluid reservoir;

a trigger extending a between a first portion and a second portion;

a base pivot pivotably mounting said trigger relative to said base;

a first and a second cam defined in said first portion of said trigger;

a linkage engaging with said piston;

a first and a second cam follower located on said linkage for coupling with said first and second cams defined in said first portion of said trigger;

said first cam follower having a first lower cam follower and a first upper cam follower;

said second cam follower having a second lower cam follower and a second upper cam follower;

said first lower cam follower and said first upper cam follower engaging with said first cam in difference orientations between an unattended trigger position and a fully depressed trigger position for enabling a pivoting movement of said second portion trigger to move linearly said piston to spray fluid from said pump body orifice;

said second lower cam follower and said second upper cam follower engaging with said second cam in difference orientations between an unattended trigger position and a fully depressed trigger position for enabling said pivoting movement of said second portion trigger to move linearly said piston to spray fluid from said pump body orifice; and an appendage coupling member extending between said linkage for preventing diverging of said linkage upon actuation of said trigger.

* * * * *